US006520900B1

(12) United States Patent
Sandford

(10) Patent No.: US 6,520,900 B1
(45) Date of Patent: Feb. 18, 2003

(54) METHODS FOR ERECTION OF FEMALE BLANKING DIE AND UNIVERSAL PRESS FRAMES FOR USE IN SUCH METHODS

(76) Inventor: Peter E. Sandford, 176 Stronach Crescent, London, Ontario (CA), N5V 3A1

( * ) Notice: Subject to any disclaimer, the term of this patent is extended or adjusted under 35 U.S.C. 154(b) by 104 days.

(21) Appl. No.: 09/692,320

(22) Filed: Oct. 20, 2000

(30) Foreign Application Priority Data

Oct. 20, 1999 (CA) ..... 2286981

(51) Int. Cl.[7] ..... B31B 49/00

(52) U.S. Cl. ..... 493/373; 493/143; 493/145; 83/103; 83/696; 144/372

(58) Field of Search ..... 493/143, 145, 493/373; 144/84, 144.1, 144.51; 83/103, 696

(56) References Cited

U.S. PATENT DOCUMENTS 1,501,072 A 7/1924 Stanbon
2,341,284 A 2/1944 Payne (List continued on next page.)

*Primary Examiner*—Eugene Kim
*Assistant Examiner*—Louis Tran
(74) *Attorney, Agent, or Firm*—Birch, Stewart, Kolasch & Birch, LLP

(57) ABSTRACT

Methods for setting-up a female blanking die for a die cutting machine for die cutting and/or blanking a carton blank, and universal press frames for use in such setting-up are all provided herein. The first stages in the erection of the female blanking die, which includes a rectangular framework of a front rail, a rear rail and two side rails, involve accurate placement of a template within the rectangular framework. All the rails are provided with a dovetail groove along its inside edges. This is achieved by the use of centre line orientation cylinders on a template, a centre line rod through aligned holes in the centre line orientation cylinders and centre line brackets at the precise centre point of the front and the rear rails. The template is mounted atop the centre line brackets by means of the centre line rod and rests loosely on template corner locking clamps. Then the template is secured to the accurately-placed template corner locking clamps in the rectangular frame, and is accurately-positioned and fixed there. The centre line cylinders are then removed and grid orientation cylinders are mounted on the template. A plurality of grid support members are selectively-disposed along the internal perimeter of the rectangular framework by cooperation with the dovetail groove of the rails. The grid comprising a plurality of intersecting rails, the pattern of the intersecting rails having a predefined shape, is disposed within slots within the grip support members and in the grid orientation cylinders and is locked into place in the grid support member. A plurality of jogger members are provided which are selectively-disposed along the internal perimeter of the rectangular framework by means of cooperation with the dovetail groove of the rails, each jogger member having a particularly-recited structure. The plurality of auxiliary adjustable support members may also be selectively-disposed along the internal perimeter of the rectangular framework by means of cooperation with the dovetail groove of the rails. The universal press frame is supported on four legs. When the template is dropped below the universal press frame, and the legs are removed, the universal press frame becomes the female blanking die.

7 Claims, 10 Drawing Sheets

U.S. PATENT DOCUMENTS 2,381,062 A 8/1945 Kirsch
2,504,642 A 4/1950 Burgess
2,572,537 A 10/1951 Taylor
3,126,776 A 3/1964 Whistler, Sr. et al.
3,148,572 A 9/1964 Lindholm
3,150,550 A 9/1964 Berlin et al.
3,249,272 A 5/1966 Scarpa
3,335,704 A 8/1967 Freebourn
3,386,781 A 6/1968 Blazek et al.
3,504,576 A 4/1970 Silberman et al.
3,554,060 A 1/1971 Gargrave et al.
3,786,731 A 1/1974 Bobst et al.
3,985,168 A * 10/1976 Lundquist ..... 144/134.1
4,164,076 A 8/1979 Carrigan
4,174,576 A 11/1979 Shepard
4,175,477 A * 11/1979 Inose et al. ..... 493/362
4,175,686 A 11/1979 Lang
4,230,164 A * 10/1980 Mericle ..... 144/144.1
4,322,191 A * 3/1982 de Sousa ..... 409/104
4,359,915 A 11/1982 Nascimento
4,371,369 A 2/1983 Wright, III
4,397,094 A 8/1983 Nakamura
4,397,095 A 8/1983 Graboyes
4,452,495 A 6/1984 Orlandea
4,489,499 A 12/1984 Frissora
4,494,455 A 1/1985 Schoch
4,555,840 A 12/1985 Nakamura
4,913,016 A 4/1990 Frei
5,179,882 A 1/1993 Takeuchi et al.
5,322,202 A 6/1994 Pelletier
5,337,639 A 8/1994 Morrison
5,402,698 A 4/1995 Morrison
5,810,233 A * 9/1998 Varidel ..... 225/105
5,813,807 A * 9/1998 Rogers ..... 144/144.51

* cited by examiner

METHODS FOR ERECTION OF FEMALE BLANKING DIE AND UNIVERSAL PRESS FRAMES FOR USE IN SUCH METHODS

TECHNICAL FIELD TO WHICH THE INVENTION RELATES

The present invention relates generally to an improvement in apparatus for the automatic die cutting of blanks primarily for making formable paperboard containers. In particular, it relates to the erection of the female blanking die for use in the blanking operation.

This invention claims priority of co-pending Canadian Patent Application No. 2,259,785, the entire contents of which are incorporated herein.

BACKGROUND ART

With the advent of many different sizes, shapes and configurations of cardboard or similar type containers, it is well-known in the art to die-cut, strip and blank cardboard box blanks using an automatic sequential press or die cutting machine. By automating the process and by using computer-aided technology, it is now possible to configure die-cut blanks in a limitless number of dimensions and specifications. It is also now possible to lay-out any number of blanks on a single sheet of cardboard while automatically cutting, stripping and blanking the sheets with little or no human operator intervention. One typical system and press known in the art is discussed in U.S. Pat. No. 5,337,639, issued Aug. 16, 1994 and assigned to Die-X Tooling Systems.

As described in that U.S. Pat. No. 5,337,639, computer technology, combined with attendant laser technology, has enabled cardboard box manufacturers to utilize highly-accurate cutting and creasing dies for producing a planar sheet of die-cut blanks, and also to produce male and female blanking dies used automatically to separate the die-cut or stamped forms from the intervening web or waste portion of the sheet. Automatic blanking, in particular, results in a tremendous cost savings compared to the identical operation when performed by labourers using manual blanking means.

The current technology and the known prior art includes automatic systems or presses that feed large sheets of cardboard for cutting and scoring of blanks and also, for automatically stripping the excess cardboard from the stamped cardboard sheet, leaving a flexible thin webbing supporting the various rows of stamped carton forms. The known prior art also contemplated the use of a male and female combination blanking die for automatically separating the planar forms from the flexible web. The male die, effective through the use of a blanking member, pushed each of the cardboard cartons which were blanked through the web and through the apertures in the supporting female die. The thin web typically remained on the face of the female die, while the separated blanks were pushed through the blanking holes into a stack below the female blanking die.

For speed and efficiency, the prior art also contemplated the use of a travelling feed bar and grippers to "pull" a cardboard sheet through the various stations of the machine on a continuous chain drive or other mechanism, thereby automatically feeding the sheet from station to station. Similarly, in most applications, the remaining flexible web on the face of the female die after blanking was also pulled away through the use of the travelling bar and grippers into a waste container or other receptacle at the end of the machine.

The general configuration of automatic die cutting machines for the production of such die-cut blanks is well-known. A sheet of cardboard blank material was automatically interposed or urged by mechanical means beneath the surface of a cutting die as part of the first stage of the operation. The cutting die comprised a planar die having specially configured cutting edges which were created through the use of computer and laser technology to reflect a particular series of die-cut blank lay-outs for cutting. Once a sheet was interposed under the cutting die on a cutting plate, the cutting die was pressed onto the sheet from below thereby causing the sheet to be "cut" or "scored" by the cutting die thereabove.

While not essential for a thorough understanding of the present invention, a typical system and press known in the art for automatic die cutting and blanking, which is taught in that U.S. Pat. No. 5,337,639, will now be briefly-described.

The press generally comprised means for feeding a series of blank, planar sheets into the press or system, e.g., by the use of a travelling bar and appended pulling grippers and then to a scoring and/or cutting station. Thereafter, at the scoring or stamping station, a plurality of rows and columns of die-cut forms were stamped or scored on to the cardboard sheet. The cardboard sheet remained in one piece and was next pulled automatically to a stripping station, where much of the small pieces of excess cardboard around the die-cut forms were automatically removed. What remained was a series of stamped and creased die-cut forms, which were held together by a thin web therebetween. The thin web and attached die-cut blanks were then automatically pulled into a blanking station where the die-cut blanks were completely separated from the web and then were dropped onto a pallet for transfer.

The blanking station specifically included the use of a male blanking die/female blanking die combination which, when engaged, pressed and separated the box blanks from the web and onto the pallet. The remaining thin web lay on the face of the female die component and was ready for disposal in a disposal area at the end of the press. As a result of the blanking operation, a planar cardboard blank was produced and was in a condition for assembly, by automatic folding or otherwise, for example, for the insertion of merchandise, food stuffs or other products to be contained therein.

That male blanking die/female blanking die combination included a female blanking die portion and a complementary male blanking die for blanking or separating die-cut cardboard carton blanks or other forms into a detached web and a substantially planar and unassembled die-cut cardboard blank. The die-cut cardboard sheet was automatically pulled through the press, and over the female die portion, through the use of travelling bar having appended gripper fingers which were adapted to grip the leading edge of the die-cut sheet.

After blanking, the web remained on the face of the female die portion and included a series of intermediate web portions which, together, formed an extremely flexible and flimsy cardboard "skeleton" which must be removed from the female blanking die face. In actual operation, the travelling bar and appended grippers pulled the flexible web over the female blanking die face, including the leading edges of the female blanking die.

In the operation of the blanking dies, the male blanking die was pressed downward through the corresponding through holes in the female blanking die, thereby separating and pushing the blanked cardboard carton through the through holes, resulting in die-cut blanks and leaving a cardboard web on the surface of the female blanking die. At this point, it was then necessary automatically to remove the remaining web portion from the face of the female blanking die by use of the travelling bar and grippers.

After the initial cutting process, the entire cut or scored sheet was automatically pulled or urged into a second (or "stripping") station for the operation for the stripping away of most of the excess material from around the cut box blanks. The stripping operation comprised the use of a female stripping tool onto which the cut sheet was automatically interposed. The female stripping tool had a series of configured openings which corresponded to the cut portions of the cut sheet and was adapted to receive the male stripping tool from above. The male stripping tool cooperated with the female stripping tool, and effectively broke away and separated the majority of excess material from the box blanks by being urged downwardly onto the sheet arranged over the female stripping tool. It was, of course, critical that the male and female stripping tools be aligned precisely and that the cut sheet be arranged in alignment therebetween to insure that stripping was effectively accomplished without tearing of the box flank, jamming of the machine or damage thereto. Further, precise alignment was required because of the narrow tolerances necessary to assemble the box or container which was formed from the cut sheet.

On machines so-configured, the stripped sheet was next urged in between yet another series of male and female blanking tools which were arranged one above the other, which were again required to be in precise alignment. Thereabove, the female blanking tool was adapted to receive the die-cut blank which was stripped at the previous station and which had a series of openings directly corresponding to the shapes of the cut boxes to be blanked. In turn, the corresponding male blanking tool of similar contour to that of the female tool was adapted to push the cut box blanks free from any remaining extraneous material, and through the female blanking tool into a stack therebelow. Accordingly, it was once again required that the male and female blanking tools be carefully-aligned and that the sheet to be blanked was precisely-arranged therebetween to avoid problems similar to those described in the stripping portion of the operation. After blanking was completed, the remaining extraneous material was then urged off the face of the female blanking tool into a refuse area and the process continued again from the beginning.

It is well-known and recognized in the prior art that the set-up of the cardboard blank cutting machine is critical to efficient and proper automatic cutting, stripping and blanking of multiple box blanks. The alignment method practised in the art was a manual one which relied upon the senses and vision of the operator, to manually-adjust the stripping and blanking tools through use of the applicable alignment means of a particular machine press. Accordingly, it was not unusual for machine set-up to take anywhere from four to six hours, especially for complex box layouts comprising various series of boxes and orientations. Due to the precision required and the high tolerances of the components, the method of manually-setting-up the machine required that the machine be "down" for extended periods of time between production runs. This, of course, resulted in diminished capacity and productivity and affected the overall cost of production and price of the box blanks.

Many patents have been issued heretofore which were concerned with the erection of dies of a die cutting machine.

One patent was U.S. Pat. No. 2,504,642, patented Apr. 18, 1950, to W. D. Burgess, which provided a method of positioning die and punch holders which were in correct positions relatively to each other on die and punch shoes, on which they could be adjusted and fastened. The method included positioning the die holders by means of a template and positioning the punch holders by means of set-up plugs which fit in the die holders and which had a bore equal to the diameter of the punch body. A punch with a set-up plug therein was first attached to a punch holder, after which the set-up plug was moved into position on a die holder correctly to position the punch holder relatively to the die holder.

Another patent was U.S. Pat. No. 3,126,776, patented Mar. 31, 1964, by L. V. Shisler et al., which provided a method of aligning the punch and die retainers of a die set. The method included fixedly-mounting a first retainer upon an associated shoe in the proper position. Then, a spotting fixture was mounted onto the first retainer, so as to prevent relative rotation therebetween. A supporting shoe was brought into contact with an upper portion of the spotting fixture, to provide an indication on the under surface of the supporting shoe of the proper position of mounting holes. The supporting shoe was then removed from contact with the spotting fixture, and mounting holes were formed in the supporting shoe. A second retainer was loosely-mounted onto the supporting shoe, by inserting attaching means in the mounting holes. Then, the first and second retainers were accurately-aligned. Finally, the second retainer was secured in a final fixed position on the supporting shoe.

Yet a further patent was U.S. Pat. No. 3,150,550, patented Sep. 29, 1964 by M. Berlin et al., which provided a method of resetting a female rule die member and a rigid male punch member, which previously were matched, aligned and mounted as a unit, in a device which had two relatively-reciprocatable parts. The method included the steps of mounting the members on the reciprocatable parts of such a device so that at least one member was shiftable relative to its associated part in two orthogonal directions which were perpendicular to the direction of relative movement of the parts. The compression means were then manipulated to constrict the die blade. One member was then relatively shifted in the two orthogonal directions, so as to align the two members. Subsequently, one member was fixedly-secured to its associated part.

Another patent was U.S. Pat. No. 3,386,781, patented Jun. 4, 1968, by W. J. Blazek et al., which provided a die set comprising a pair of members which were movable toward, and from, one another. Means were provided for maintaining alignment between the members during movement thereof. The means included a guide pin which was carried for limited lateral adjustment on one of the members, and which telescoped with a tubular guide bushing which was carried for limited lateral adjustment on the other of the members. Fastening means were carried by each of the members for detachably-securing the guide pin and bushing, respectively, thereto. The fastening means provided for limited lateral adjustment of the positions of attachment of the pin and the bushing to the members.

Still another patent was U.S. Pat. No. 3,504,576, patented Apr. 7, 1970, by R. L. Silberman et al., which provided a precision die set comprising a punch holder and a die holder and a method of making a precision die set. The punch holder and die holder were guided for precise movement relative to one another by guide posts, which were secured at one end to the die holder and which cooperated with bushings which were affixed to the punch holder at the other end. The guide posts and bushings were loosely-received in non-precision made openings in the punch holder and die holder, and were retained in place by an epoxy adhesive. The epoxy adhesive was applied between the bushings and punch holder, and between the guide posts and die holder. Before the epoxy adhesive was cured, the guide posts were disposed perpendicular to the die holder and parallel to one another, with the guide posts engaging with their associated bushings, so as properly to position the bushings in the punch holder. Then, the epoxy adhesive was cured to retain the components in precise assembled relationship.

Yet another patent was U.S. Pat. No. 4,164,076 patented Aug. 14, 1979, by R. J. Corrigan, which provided a mounting plate for securing the position of a machine tool. Such mounting plate included a plurality of slot groupings which extended radially from a plate centre point. Radial axes of each slot group were distributed equiangularly about the centerpoint. Each slot grouping included at least two spaced-apart-apart lines of short, spaced-apart-apart slots extending parallel with the respective radial axis. The slots and spaces were aligned in radial sequence along a respective line, and were laterally offset by the slot and space sequence of the other line. Therefore, a space of one line was laterally-flanked by a slot in the other line.

Still a further patent was U.S. Pat. No. 4,359,915, patented Nov. 23, 1982, by A. V. Nascimento, which provided a method of making a precision die set. This method included the first step of mounting a first retainer block upon a die shoe in the proper position, by alignment with a punch shoe and applying shear plastic to hold the retainer block in position. That step was repeated with a multiplicity of retainer blocks. The retainer blocks were secured to the die shoe by means of a metal top plate.

The die shoe assembly was then removed from a pedestal. Appropriate dowel-receiving and screw-receiving holes were then appropriately-drilled.

Yet a further patent was U.S. Pat. No. 4,397,094, patented Aug. 9, 1983, by I. Nakamura, which provided an apparatus for accurately-locating and aligning dies. The apparatus included a die changing apparatus which included a pair of upper and lower die fixtures, which had locating pins on the sides facing each other. A pair of base plates was provided for securing the upper and the lower dies. This pair of base plates had a plurality of openings which were sized and positioned for receiving the locating pins, and for locating one each of the base plate on the fixtures. Means were provided for removably-securing one of the base plates on each fixture. At least two guide posts were provided, each of which had a stud portion which was sized and positioned for insertion into one of the openings in one of the base plates (of the pair of base plates). A guide portion was then inserted into another of the openings, which were provided on the remaining base plate (of the pair of the base plates). This permitted vertical-reciprocal movement of the other base plate along the length of the guide post. The guide portion and the stud portion were coaxial and were of the same diameter, in order to permit precise alignment of the dies on the base plates relative to the openings therein. Means were provided for removably-fastening each guide post to the base plates so as temporarily to erect each guide post on the base plates, prior to positioning the base plates on the die changing apparatus fixture via the pins and the openings.

Yet a further such patent was U.S. Pat. No. 4,397,095, patented Aug. 9, 1983, by H. A. Graboyes. This patent provided means for securing the die over the counterplate in an opposed face-to-face manner and in a precise aligned relationship for transfer to a press, where the scoring and cutting of sheet material occurred. The die and counterplate securing means included a bushing which had a longitudinal bore and a guide pin, which was adapted to fit snugly into the longitudinal bore of the bushing. An opening was formed in one of either the die or the counterplate, and the bushing was fitted into that opening and was secured to one of either the die or counterplate. The bushing included an end portion which extended beyond the opposing face of one of the die or the counterplate. The end portion of the bushing had a transverse bore therethrough, which intersected its longitudinal bore. The guide pin was secured to the other of the die or the counterplate. Such guide pin protruded from the opposing face of the other of the die or the counterplate, and had a side wall with a groove therein. The guide pin was fitted into the longitudinal bore of the bushing when the die and counterplate were in their aligned relationship, i.e., with the guide pin groove registering with the transverse bore of the bushing. A removable lock pin means was fitted into the registering guide pin groove and into the transverse bore of the bushing, for securing the guide pin within the bushing. The guide pin groove had a width which exceeded the transverse dimension of the lock pin means, to permit limited relative longitudinal movement of the guide pin within the bushing, and to allow aligned movement of the die relative to the counterplate.

Yet a further such patent was U.S. Pat. No. 4,555,840, patented Dec. 3, 1987, by I. Nakamura, which provided a method for accurately-locating and accurately-aligning dies with respect to a pair of upper and lower die fixtures having locating pins. The method included the steps of first uprightly-mounting guide posts into the openings of one of a pair of base plates, by inserting ends of the guide posts into the openings of the base plate. The openings of one base plate were positioned such that the locating pins of one of such die fixtures fit therein when that one of the base plates was mounted therein. Then a remaining one of the pins of the base plates was mounted for vertical reciprocal movement on the uprightly-erected guide posts, by slidably-inserting the other ends of the guide posts into openings of the remaining base plate of the pair of base plates. Thus, the assembled pair of the base plates were in the form of a die set which were accurately-aligned in the openings of the respective base plates. The openings of the remaining base plate were positioned such that the locating pins of another of the die fixtures fit therein, when the remaining base plate was mounted therein. The dies were then located in the pair of the base plates assembled in the form of the die set for accurately-aligning each of the dies, and the dies were secured to respective ones of the base plates in defined locations thereof. One base plate was mounted to the die fixture with the pins of the one die fixture being inserted into the holes of the one base plate. Finally, the remaining base plate was mounted to the other die fixture, with the pins of the other die fixture inserted into the holes of the remaining base plate.

U.S. Pat. No. 5,402,698, issued Apr. 4, 1995 to Morrison and assigned to Die-X Tooling Systems, provided a method for aligning the tools of a typical box blank die cutting machine. This method contemplated the use of alignment openings on the surface of male and female tools, which corresponded to a cut through-hole on test sheet. As the test sheet was urged through the stages of the machine, a series of alignment cylinders were used to insure that each of the male and female tools and the test sheet were aligned, by having the alignment cylinders fall clearly-through the various alignment openings and the through-hole. Once the tools at each position of the process were aligned, alignment screws and alignment members on the machine frame served to fix the position of the tools, relative to the position of the sheets to be die-cut, stripped, and blanked. Accordingly, the method contemplated the alignment and the set-up of the machine, based upon the urged position of the sheets to be scored and cut.

Applicant's co-pending application Ser. No. 2,259,785, filed Jan. 19, 1999, on which the present application claims priority, and which is incorporated herein provided an effective solution to the deficiencies of the prior art. That application provided a female blanking die for a die cutting machine for die cutting and/or blanking a carton blank, as well as a combination male blanking die/female blanking die, and methods of producing them. The male blanking die/female blanking die combination included a male stripping die comprising a template having a particularly-specified perimeter, the template including a plurality of foam plastic pads which were removably secured to the undersurface of the template, the template being accurately secured at a predetermined position to the underface of a movable upper plate of the blanking station of the die cutting machine. The male blanking die/female blanking die combination also included a female blanking die comprising a rectangular framework and a plurality of grid support members, each grid support member having a slot across its upper face, the grid support members being selectively disposed along the internal perimeter of the rectangular framework. A grid was provided comprising a plurality of intersecting rails, the pattern of the intersecting rails having a predefined shape. The grid was disposed within the slots atop the grid support members. A plurality of jogger members were provided which were selectively-disposed along the internal perimeter of the rectangular framework, each jogging member having a particularly-recited structure. The plurality of jogger members were oriented along the internal perimeter of the rectangular framework in a particularly-recited way. The female blanking die was accurately-secured at a predetermined position atop a lower fixed plate of the blanking station of the die cutting machine. The male stripping die and the female blanking die were accurately-aligned to cooperate to press and separate the carton blanks from a web holding them together, and to force the separated cartons through aligned openings in the female blanking die.

DESCRIPTION OF THE INVENTION

While many of the above patents alluded to the solving of the problem of aligning the male blanking die with the female blanking die, with the die-cut carton blanks then being pushed through the female blanking die onto a stack of cartons below, in practice, such problem has not yet been satisfactorily-solved. Moreover, there is still a need for the setting-up of a female blanking die for use with a male blanking die so that the blanked sheets may be suitably-aligned in a fixed orientation prior to the blanked cartons being discharged from the blanking machine to a pallet for transfer.

Accordingly, an object of one aspect of the present invention is to provide a means and method for setting-up a female blanking die for use in a die cutting machine.

An object of another aspect of the present invention is to provide a method for setting-up an improved female blanking die.

An object of yet still another aspect of the present invention is to provide a system of novel components for setting-up an improved female blanking die.

By a first broad aspect of this invention, a method is provided for setting-up a female blanking die for a die cutting machine, the method comprising the steps of a) providing a universal press frame including a front rail, a rear rail and two side rails to provide a rectangular frame, the rails each being provided with a dovetail groove along its inside edge, the rectangular frame having a longitudinally-extending centre line which is marked on the front rail and on the rear rail and particularly-specified datum lines which are marked on the side rails, b) providing a template, the shape of the template being of the outer shape of a sheet containing a plurality of cartons which have been die-cut by the die cutting machine, and also including thereon a centre line and other datum points for accurately-aligning the template within the universal press frame to provide a female blanking die, the template including centre line datum apertures along the centre line adjacent to the front end and to the rear end of the template and other datum apertures at the other datum points, the apertures including retention means within such apertures, c) providing a pair of centre line orientation cylinders, each the centre line orientation cylinder including an upper cylindrical barrel, an aperture extending through the upper barrel and means for removably-disposing the centre line orientation cylinders within two longitudinally-spaced-apart centre line apertures along the centre line of the template adjacent to a front rail and a rear rail, respectively, and removably-inserting the centre line orientation cylinders therein, d) providing an elongated member and inserting the elongated member through aligned apertures through the upper barrel of the longitudinally-spaced-apart, centre line orientation cylinders, with the ends of the elongated member projecting beyond the front edge and the back edge of the template, e) providing a pair of centre line brackets, each the centre line bracket including a lower means for securing the centre line brackets to the front rail or to the rear rail, respectively, of the universal press frame and an upper extension including a central cradle of a shape which is similar to the shape of the elongated member, and securing the centre line brackets to the front rail and to the rear rail, respectively, exactly at the marked centre lines of the front rail and of the rear rail, f) providing four template corner locking clamps, each template comer locking clamp including means to secure it to a side rail of the universal press frame and a slotted inwardly-directed arm, and securing each comer locking clamp to an associated side rail at the particularly-specified datum lines adjacent to the front rail and the rear rail, with the slotted arm projecting into the interior area of the universal press frame, g) placing the template and with its attached elongated member thereon within the universal press frame with the projecting ends of the elongated member within the central cradles in the front centre line bracket and the rear centre line bracket, respectively, and resting on the template corner locking clamps, h) securing an associated comer of the template to a respective template comer locking clamp by means passing through the slotted arm and engaged within a preselected relevant datum aperture in the template, and i) removing the centre line orientation cylinders and the centre line brackets, after the template has been so accurately secured.

By a first variation of this first broad aspect of this invention, the elongated member is an elongated cylindrical rod.

By a second broad aspect of this invention, a method is provided for setting-up a female blanking die for a die cutting machine, the method comprising the steps of a) providing a universal press frame including a front rail, a rear rail and two side rails to provide a rectangular frame, the side rails each being provided with a dovetail groove along its inside edge, the rectangular frame having a longitudinally-extending centre line which is marked on the front rail and on the rear rail and particularly-specified datum lines which are marked on the side rails, b) providing a template, the shape of the template being of the outer shape of a sheet containing a plurality of cartons which have been die-cut by the die cutting machine, and also including thereon a centre line and other datum points for accurately-aligning the template within the universal press frame to provide a female blanking die, the template including two longitudinally-spaced-apart apertures along the centre line adjacent to the front end and to the rear end of the template and other datum apertures at the other datum points, the apertures including retention means within such apertures, the underside of the template including a plurality of removably-secured foam plastic blocks, which are disposed in accurately-predetermined locations thereon, c) providing a pair of centre line orientation cylinders, each the centre line orientation cylinder including an upper cylindrical barrel, a circular aperture extending through the upper barrel and means for removably-disposing the centre line orientation cylinders within the two longitudinally-spaced-apart centre line apertures along the centre line of the template, and removably-inserting the centre line orientation cylinders therein, d) providing an elongated cylindrical rod, and inserting the elongated cylindrical rod through aligned circular apertures through the upper barrels of the longitudinally-spaced-apart centre line orientation cylinders, with the ends of the elongated cylindrical rod projecting beyond the front edge and the back edge of the template, e) providing a pair of centre line brackets, each the centre line bracket including a lower means for securing the centre line bracket to a front rail or to a rear rail, respectively, of the universal press frame, and an upper extension including a central semi-cylindrical cradle, and securing the centre line brackets to the front rail and to the rear rail, respectively, exactly at the marked centre lines of the front rail and of the rear rail, f) providing four template corner locking clamps, each template comer locking clamp including means to secure it to a side rail of the universal press frame and a slotted inwardly-directed arm, and securing each corner locking clamp to an associated side rail at the particularly-specified datum lines adjacent to the front rail and adjacent to the rear rail, with the slotted arm projecting into the interior area of the universal press frame, g) placing the template with its attached elongated cylindrical rod within the universal press frame with the projecting ends of the elongated cylindrical rod resting within the central semi-cylindrical cradle in the front centre line bracket and in the rear centre line bracket, respectively, and resting on the template corner locking clamps, h) securing an associated corner of the template to a respective template comer locking clamp by means passing through the slotted arm and engaged within a preselected relevant datum aperture in the template, i) removing the centre line orientation cylinders and the centre line brackets, after the template has been so accurately-secured, j) providing a plurality of jogger members, each jogger member comprising a base member and means for insertion in the dovetail groove of the rails, an adjustable support member which is adjustably-slidably-disposed with respect to the base member, and a guiding member having an upper edge and a lower edge, the guiding member being secured to one face of the adjustable support member to provide a depending guiding face, disposing the jogger members in spaced-apart orientation along the interior periphery of the universal press frame on the side rails, on the front rail and on the rear rail, and adjusting the plurality of jogger members until the depending guiding faces of the jogger members abut selected edges of the periphery of the template, the abutted guiding faces of the depending guiding members, together with the template, thereby constituting a perimeter that is substantially-identical to the outer perimetrical shape of a sheet containing a plurality of carton blanks which have been die-cut from a sheet by a male cutting die of the die cutting machine, k) removing the securing means of the template to the template corner locking clamps and removing the template corner locking clamps, thereby allowing the template to drop freely below the fixed grid and below the universal press frame, and 1) removing the template from below the universal press frame.

By a third broad aspect of this invention, a method is provided for setting-up a female blanking die for a die cutting machine, the method comprising the steps of a) providing a universal press frame including a front rail, a rear rail and two side rails to provide a rectangular frame, the side rails each being provided with a dovetail groove along its inside edge, the rectangular frame having a longitudinally-extending centre line which is marked on the front rail and on the rear rail, and particularly-specified datum lines which are marked on said side rails, b) providing a template, the shape of the template being of the outer shape of a sheet containing a plurality of cartons which have been die-cut by the die cutting machine, and also including thereon a centre line and other datum points for accurately-aligning the template within the universal press frame to provide a female blanking die, the template including two longitudinally-spaced-apart apertures along the centre line adjacent to the front end and adjacent to the rear end of the template and other datum apertures at the other datum points, the apertures including retention means within such apertures, the underside of the template including a plurality of removably-secured foam plastic blocks, which are disposed in accurately-predetermined locations thereon, c) providing a pair of centre line orientation cylinders, each the centre line orientation cylinder including an upper cylindrical barrel, a circular aperture extending through the upper barrel and means for removably-disposing the centre line orientation cylinders within the two longitudinally-spaced-apart centre line apertures along the centre line of the template, and removably-inserting the centre line orientation cylinders therein, d) providing an elongated cylindrical rod, and inserting the elongated cylindrical rod through aligned circular apertures through the upper barrels of the longitudinally-spaced-apart centre line orientation cylinders, with the ends of the elongated cylindrical rod projecting beyond the front edge and the back edge of the template, e) providing a pair of centre line brackets, each the centre line bracket including a lower means for securing the centre line bracket to a front rail or to a rear rail, respectively, of the universal press frame, and an upper extension including a central semi-cylindrical cradle, and securing the centre line brackets to the front rail and to the rear rail, respectively, exactly at the marked centre lines of the front rail and of the rear rail, f) providing four template corner locking clamps, each template corner locking clamp including means to secure it to a side rail of the universal press frame and a slotted inwardly-directed arm, and securing each corner locking clamp to an associated side rail at the particularly-specified datum lines adjacent to the front rail and adjacent to the rear rail, with the slotted arm projecting into the interior area of the universal press frame, g) placing the template with its attached elongated cylindrical rod within the universal press frame with the projecting ends of the elongated cylindrical rod resting within the central semi-cylindrical cradle in the front centre line bracket and in the rear centre line bracket, respectively, and resting on the template corner locking clamps, h) securing an associated corner of the template to a respective template corner locking clamp by means passing through the slotted arm and engaged within a preselected relevant datum aperture in the template, i) removing the centre line orientation cylinders and the centre line brackets, after the template has been so accurately-secured, and j) providing a plurality of jogger members, each jogger member comprising a base member and means for insertion in the dovetail groove of the rails, an adjustable support member which is adjustably-slidably-disposed with respect to the base member, and a guiding member having an upper edge and a lower edge, the guiding member being secured to one face of the adjustable support member to provide a depending guiding face, the jogger member also including slidable captive cap means having a leading edge, the slidable captive cap means being slidably-secured to the depending guiding member, disposing the jogger members in spaced-apart orientation along the interior periphery of the universal press frame on the side rails, on the front rail and on the rear rail, respectively, adjusting the plurality of jogger members until the depending guiding faces of the jogger members abut selected edges of the periphery of the template, the abutted guiding faces of the depending guiding members, together with the template, thereby constituting a perimeter that is substantially-identical to the outer perimetrical shape of a sheet containing a plurality of carton blanks which have been die-cut from a sheet by a male cutting die of the die cutting machine, and disposing the leading edge of the slidable captive cap means a predetermined cantilevered distance over the depending guiding face of the depending guiding member, the leading edges of the slidable captive cap means which are atop the depending guiding members thereby extending as far as an "imaginary" perimeter which would be defined by joining the leading edges of the slidable captive cap means which constitutes a perimeter that is substantially-similar to, but is slightly larger than, the perimetrical shape of a sheet containing the carton blanks which have been die-cut by the male cutting die of the die cutting machine, so that the slidable captive cap means provide a temporary support for selected areas of the sheet containing the carton blanks which have been die-cut from a sheet by the male cutting die of the die cutting machine, k) removing the securing means of the template to the template corner locking clamps and removing the template comer locking clamps, thereby allowing the template to drop freely below the fixed grid and below the universal press frame, and 1) removing the template from below the universal press frame.

By a fourth broad aspect of this invention, a method is provided for setting-up a female blanking die for a die cutting machine, the method comprising the steps of a) providing a universal press frame including a front rail, a rear rail and two side rails to provide a rectangular frame, the side rails each being provided with a dovetail groove along its inside edge, the rectangular frame having a longitudinally-extending centre line which is marked on the front rail and on the rear rail, and particularly-specified datum lines which are marked on the side rails, b) providing a template, the shape of the template being of the outer shape of a sheet containing a plurality of cartons which have been die-cut by the die cutting machine, and also including thereon a centre line and other datum points for accurately-aligning the template within the universal press frame to provide a female blanking die, the template including two longitudinally-spaced-apart apertures along the centre line adjacent to the front end and to the rear end of the template and other datum apertures at the other datum points, the apertures including retention means within such apertures, the underside of the template including a plurality of removably-secured foam plastic blocks, which are disposed in accurately-predetermined locations thereon, c) providing a pair of centre line orientation cylinders, each the centre line orientation cylinder including an upper cylindrical barrel, a circular aperture extending through the upper barrel and means for removably-disposing the centre line orientation cylinders within the two longitudinally-spaced-apart centre line apertures along the centre line of the template, and removably-inserting the centre line orientation cylinders therein, d) providing an elongated cylindrical rod, and inserting the elongated cylindrical rod through aligned circular apertures through the upper barrels of the longitudinally-spaced-apart centre line orientation cylinders, with the ends of the elongated cylindrical rod projecting beyond the front edge and the back edge of the template, e) providing a pair of centre line brackets, each the centre line bracket including a lower means for securing the centre line bracket to a front rail or to a rear rail, respectively, of the universal press frame, and an upper extension including a central semi-cylindrical cradle, and securing the centre line brackets to the front rail and to the rear rail, respectively, exactly at the marked centre lines of the front rail and of the rear rail, f) providing four template corner locking clamps, each template corner locking clamp including means to secure it to a side rail of the universal press frame and a slotted inwardly-directed arm, and securing each corner locking clamp to an associated side rail at the particularly-specified datum lines adjacent to the front rail and adjacent to the rear rail, with the slotted arm projecting into the interior area of the universal press frame, g) placing the template with its attached elongated cylindrical rod within the universal press frame with the projecting ends of the elongated cylindrical rod resting within the central semi-cylindrical cradles in the front centre line bracket and in the rear centre line bracket, respectively, and resting on the template corner locking clamps, h) securing an associated corner of the template to a respective template corner locking clamp by means passing through the slotted arm and engaged within a preselected relevant datum aperture in the template, i) removing the centre line orientation cylinders and the centre line brackets, after the template has been so accurately-secured, j) providing a plurality of grid orientation cylinders, each the grid orientation cylinder including an upper barrel, at least one orientatable slot in the upper barrel end and having means for removably-disposing the grid orientation cylinders in preselected datum apertures in the template, and inserting the grid orientation cylinders in the preselected datum apertures in the template, k) providing a plurality of grid support members, each grid support member including means to secure it to a rail of the universal press frame, and a longitudinally-extending slot in its upper end, and disposing the grid support members in spaced-apart orientation along the interior periphery of the universal press frame on the side rails, on the front rail and on the rear rail, respectively, 1) providing a plurality of jogger members, each jogger member comprising a base member and means for insertion in the dovetail groove of the rails, an adjustable support member is adjustably-slidably-disposed with respect to the base member, and a guiding member having an upper edge and a lower edge, the guiding member being secured to one face of the adjustable support member to provide a depending guiding face, disposing the jogger members in spaced-apart orientation along the interior periphery of the universal press frame on the side rails, on the front rail and on the rear rail, adjusting the plurality of jogger members until the depending guiding faces of the jogger members abut selected edges of the periphery of the template, the abutted guiding faces of the depending guiding members, together with the template, thereby constituting a perimeter that is substantially-identical to the outer perimetrical shape of a sheet containing a plurality of carton blanks which have been die-cut from a sheet by a male cutting die of the die cutting machine, m) providing a grid comprising a plurality of intersecting longitudinal and transverse grid rails, the intersecting grid rails coinciding with abutting portions of the plurality of cartons which have been die-cut from a sheet by a male cutting die of the die cutting machine, disposing the grid rails in selected slots in the grid orientation cylinders atop the template and in the slots in the grid support members, in order accurately to position the grid in the universal press frame, securing longitudinal and transverse projecting portions of the grid rails which are disposed in the slots in the grid support members in fixed position in the slots, and then securing the grid support members in locked positions on the interior perimeter of the universal press frame, thereby accurately to fix the grid to the universal press frame, n) removing the securing means of the template to the template corner locking clamps and removing the template corner locking clamps, thereby allowing the template to drop freely below the fixed grid and below the universal press frame, and o) removing the template from below the universal press frame.

By a fifth broad aspect of this invention, a method is provided for setting-up a female blanking die for a die cutting machine, the method comprising the steps of a) providing a universal press frame including a front rail, a rear rail and two side rails to provide a rectangular frame, the side rails each being provided with a dovetail groove along its inside edge, the rectangular frame having a longitudinally-extending centre line which is marked on the front rail and on the rear rail, and particularly-specified datum lines which are marked on said side rails, b) providing a template, the shape of the template being of the outer shape of a sheet containing a plurality of cartons which have been die-cut by the die cutting machine, and also including thereon a centre line and other datum points for accurately-aligning the template within the universal press frame to provide a female blanking die, the template including two longitudinally-spaced-apart apertures along the centre line adjacent to the front end and to the rear end of the template and at the particularly-specified datum lines at the other datum points, the apertures including retention means within such apertures, the underside of the template including a plurality of removably-secured foam plastic blocks, which are disposed in accurately-predetermined locations thereon, c) providing a pair of centre line orientation cylinders, each the centre line orientation cylinder including an upper cylindrical barrel, a circular aperture extending through the upper barrel and means for removably-disposing the centre line orientation cylinders within the two longitudinally-spaced-apart centre line apertures along the centre line of the template, and removably-inserting the centre line orientation cylinders therein, d) providing an elongated cylindrical rod, and inserting the elongated cylindrical rod through aligned circular apertures through the upper barrels of the longitudinally-spaced-apart centre line orientation cylinders, with the ends of the elongated cylindrical rod projecting beyond the front edge and the back edge of the template, e) providing a pair of centre line brackets, each the centre line bracket including a lower means for securing the centre line bracket to a front rail or to a rear rail, respectively, of the universal press frame, and an upper extension including a central semi-cylindrical cradle, and securing the centre line brackets to the front rail and to the rear rail, respectively, exactly at the marked centre lines of the front rail and of the rear rail, f) providing four template corner locking clamps, each template corner locking clamp including means to secure it to a side rail of the universal press frame and a slotted inwardly-directed arm, and securing each corner locking clamp to an associated side rail at the particularly-specified datum lines adjacent to the front rail and adjacent to the rear rail, with the slotted arm projecting into the interior area of the universal press frame, g) placing the template with its attached elongated cylindrical rod within the universal press frame with the projecting ends of the elongated cylindrical rod resting within the central semi-cylindrical cradles in the front centre line bracket and in the rear centre line bracket, respectively, and resting on the template corner locking clamps, h) securing an associated corner of the template to a respective template corner locking clamp by means passing through the slotted arm and engaged within a preselected relevant datum aperture in the template, i) removing the centre line orientation cylinders and the centre line brackets, after the template has been so accurately-secured, j) providing a plurality of grid orientation cylinders, each the grid orientation cylinder including an upper barrel, at least one orientatable slot in the upper barrel end, and having means for removably-disposing the grid orientation cylinders in preselected datum apertures in the template, and inserting the grid orientation cylinders in the preselected datum apertures in the template, k) providing a plurality of grid support members, each grid support member including means to secure it to a rail of the universal press frame, and a longitudinally-extending slot in its upper end, and disposing the grid support members in spaced-apart orientation along the interior periphery of the universal press frame on the side rails, on the front rail and on the rear rail, respectively, 1) providing a plurality of jogger members, each jogger member comprising a base member and means for insertion in the dovetail groove of the rails, an adjustable support member which is adjustably-slidably-disposed with respect to the base member, and a guiding member having an upper edge and a lower edge, the guiding member being secured to one face of the adjustable support member to provide a depending guiding face, the jogger member also including slidable captive cap means having a leading edge, the slidable captive cap means being slidably-secured to the depending guiding member, disposing the jogger members in spaced-apart orientation along the interior periphery of the universal press frame on the side rails, on the front rail and on the rear rail, adjusting the plurality of jogger members until the depending guiding faces of the jogger members abut selected edges of the periphery of the template, the abutted guiding faces of the depending guiding members, together with the template, thereby constituting a perimeter that is substantially-identical to the outer perimetrical shape of a sheet containing a plurality of carton blanks which have been die-cut from a sheet by a male cutting die of the die cutting machine, and disposing the leading edge of the slidable captive cap means a predetermined cantilevered distance over the depending guiding face of the depending guiding member, the leading edges of the slidable captive cap means which are atop the depending guiding members thereby extending as far as an "imaginary" perimeter which would be defined by joining the leading edges of the slidable captive cap means which constitutes a perimeter that is substantially-similar to, but is slightly larger than, the perimetrical shape of a sheet containing the carton blanks which have been die-cut by the male cutting die of the die cutting machine, so that the slidable captive cap means provide a temporary support for selected areas of the sheet containing the carton blanks which have been die-cut from a sheet by the male cutting die of the die cutting machine, m) providing a grid comprising a plurality of intersecting longitudinal and transverse grid rails, the intersecting grid rails coinciding with abutting portions of a plurality of cartons which have been die-cut from a sheet by a male cutting die of the die cutting machine, disposing the grid rails in selected slots in the grid orientation cylinders atop the template and in the slots in the grid support members, in order accurately to position the grid in the universal press frame, securing longitudinal and transverse projecting portions of the grid rails which are disposed in the slots in the grid support members in fixed position in the slots, and then securing the grid support members in locked positions on the interior perimeter of the universal press frame, thereby accurately to fix the grid to the universal press frame, n) removing the securing means of the template to the template corner locking clamps and removing the template corner locking clamps, thereby allowing the template to drop freely below the fixed grid and below the universal press frame, and o) removing the template from below the universal press frame.

By a sixth broad aspect of this invention, a method is provided for setting-up a female blanking die for a die cutting machine, the method comprising the steps of a) providing a universal press frame including a front rail, a rear rail and two side rails to provide a rectangular frame, the side rails each being provided with a dovetail groove along its inside edge, the rectangular frame having a longitudinally-extending centre line which is marked on the front rail and on the rear rail, and particularly-specified datum lines which are marked on the side rails, b) providing a template, the shape of the template being of the outer shape of a sheet containing a plurality of cartons which have been die-cut by the die cutting machine, and also including thereon a centre line and other datum points for accurately-aligning the template within the universal press frame to provide a female blanking die, the template including two longitudinally-spaced-apart apertures along the centre line adjacent to the front end and adjacent to the rear end of the template and other datum apertures at the other datum points, the apertures including retention means within such apertures, the underside of the template including a plurality of removably-secured foam plastic blocks, which are disposed in accurately-predetermined locations thereon, c) providing a pair of centre line orientation cylinders, each the centre line orientation cylinder including an upper cylindrical barrel, a circular aperture extending through the upper barrel and means for removably-disposing the centre line orientation cylinders within the two longitudinally-spaced-apart centre line apertures along the centre line of the template, and removably-inserting the centre line orientation cylinders therein, d) providing an elongated cylindrical rod, and inserting the elongated cylindrical rod through aligned circular apertures through the upper barrels of the longitudinally-spaced-apart centre line orientation cylinders, with the ends of the elongated cylindrical rod projecting beyond the front edge and the back edge of the template, e) providing a pair of centre line brackets, each the centre line bracket including a lower means for securing the centre line bracket to a front rail or to a rear rail, respectively, of the universal press frame, and an upper extension including a central semi-cylindrical cradle, and securing the centre line brackets to the front rail and to the rear rail, respectively, exactly at the marked centre lines of the front rail and of the rear rail, f) providing four template corner locking clamps, each template corner locking clamp including means to secure it to a side rail of the universal press frame and a slotted inwardly-directed arm, and securing each comer locking clamp to an associated side rail at the particularly-specified datum lines adjacent to the front rail and to the rear rail, with the slotted arm projecting into the interior area of the universal press frame, g) placing the template with its attached elongated cylindrical rod within the universal press frame with the projecting ends of the elongated cylindrical rod resting within the central semi-cylindrical cradles in the front centre line bracket and in the rear centre line bracket, respectively, and resting on the template comer locking clamps, h) securing an associated comer of the template to a respective template comer locking clamp by means passing through the slotted arm and engaged within a preselected relevant datum aperture in the template, i) removing the centre line orientation cylinders and the centre line brackets, after the template has been so accurately-secured, j) providing a plurality of grid orientation cylinders, each the grid orientation cylinder including an upper barrel, at least one orientatable slot in the upper barrel end, and having means for removably-disposing the grid orientation cylinders in preselected datum apertures in the template, and inserting the grid orientation cylinders in the preselected datum apertures in the template, k) providing a plurality of grid support members, each grid support bracket including means to secure it to a rail of the universal press frame, and a longitudinally-extending slot in its upper end, and disposing the grid support members in spaced-apart orientation along the interior periphery of the universal press frame on the side rails, on the front rail and on the rear rail, respectively, 1) providing a plurality of jogger members, each jogger member comprising a base member and means for insertion in the dovetail groove of the rails, an adjustable support member which is adjustably-slidably-disposed with respect to the base member, and a guiding member having an upper edge and a lower edge, the depending guiding member being secured to one face of the adjustable support member to provide a depending guiding face, disposing the jogger members in spaced-apart orientation along the interior periphery of the universal press frame on the side rails, on the front rail and on the rear rail, adjusting the plurality of jogger members until the depending guiding faces of the jogger members abut selected edges of the periphery of the template, the abutted guiding faces of the depending guiding members, together with the template, thereby constituting a perimeter that is substantially-identical to the outer perimetrical shape of a sheet containing a plurality of carton blanks which have been die-cut from a sheet by a male cutting die of the die cutting machine, m) providing a plurality of auxiliary adjustable support members, each auxiliary adjustable support table comprising a base member for securement to the side rails, to the front rail and to the rear rail of the universal press frame, and an auxiliary adjustable support table, the auxiliary adjustable support table being adjustably-slidably-disposed along a longitudinal axis of the base member, securing the auxiliary adjustable support members in spaced-apart orientation along the interior periphery of the universal press frame, along the side rails, along the front rail and along the rear rail by cooperation with the dovetail groove in the rails, and adjusting the auxiliary adjustable support members with respect to the base member to have the leading edge oriented substantially-parallel to a part of the universal press frame to which the auxiliary adjustable support table is secured, in such a way that an "imaginary" perimeter which would be defined by joining the front edges of the auxiliary adjustable support members constitutes a perimeter that is substantially-similar to, but is slightly larger than, the perimetrical shape of a sheet containing carton blanks which have been die-cut from a sheet by the male cutting die of the die cutting machine, so that the auxiliary adjustable support members provide a temporary support for selected areas of the sheet containing carton blanks which have been die-cut from a sheet by the male cutting die of the die cutting machine, n) providing a grid comprising a plurality of intersecting longitudinal and transverse grid rails, the intersecting grid rails coinciding with abutting portions of the plurality of cartons which have been die-cut from a sheet by a male cutting die of the die cutting machine, disposing the grid rails in selected slots in the grid orientation cylinders atop the template and in the slots in the grid support members, in order accurately to position the grid in the universal press frame, securing longitudinal and transverse projecting portions of the grid which are disposed in the slots in the grid support members in fixed position in the slots, and then securing the grid support members in locked position on the interior perimeter of the universal press frame, thereby accurately to fix the grid to the universal press frame, o) removing the securing means of the template to the template corner locking clamps and removing the template corner locking clamps, thereby allowing the template to drop freely below the fixed grid and below the universal press frame, and p) removing the template from below the universal press frame, thereby providing the female blanking die for the die cutting machine.

By a seventh broad aspect of this invention, a method is provided for setting-up a female blanking die for a die cutting machine, the method comprising the steps of a) providing a universal press frame including a front rail, a rear rail and two side rails to provide a rectangular frame, the side rails each being provided with a dovetail groove along its inside edge, the rectangular frame having a longitudinally-extending centre line which is marked on the front rail and on the rear rail, and particularly-specified datum lines which are marked on the side rails, b) providing a template, the shape of the template being of the outer shape of a sheet containing a plurality of cartons which have been die-cut by the die cutting machine, and also including thereon a centre line and other datum points for accurately-aligning the template within the universal press frame to provide a female blanking die, the template including two longitudinally-spaced-apart apertures along the centre line adjacent to the front end and adjacent to the rear end of the template and at the particularly-specified datum lines at the other datum points, the apertures including retention means within such apertures, the underside of the template including a plurality of removably-secured foam plastic blocks, which are disposed in accurately-predetermined locations thereon, c) providing a pair of centre line orientation cylinders, each the centre line orientation cylinder including an upper cylindrical barrel, a circular aperture extending through the upper barrel and means for removably-disposing the centre line orientation cylinders within the two longitudinally-spaced-apart centre line apertures along the centre line of the template, and removably-inserting the centre line orientation cylinders therein, d) providing an elongated cylindrical rod, and inserting the elongated cylindrical rod through aligned circular apertures through the upper barrels of the longitudinally-spaced-apart centre line orientation cylinders, with the ends of the elongated cylindrical rod projecting beyond the front edge and the back edge of the template, e) providing a pair of centre line brackets, each the centre line bracket including a lower means for securing the centre line bracket to a front rail or to a rear rail, respectively, of the universal press frame, and an upper extension including a central semi-cylindrical cradle, and securing the centre line brackets to the front rail and to the rear rail, respectively, exactly at the marked centre lines of the front rail and of the rear rail, f) providing four template corner locking clamps, each template corner locking clamp including means to secure it to a side rail of the universal press frame and a slotted inwardly-directed arm, and securing each corner locking clamp to an associated side rail at the particularly-specified datum lines adjacent to the front rail and to the rear rail, with the slotted arm projecting into the interior area of the universal press frame, g) placing the template with its attached elongated cylindrical rod within the universal press frame with the projecting ends of the elongated cylindrical rod within the central semi-cylindrical cradles in the front centre line bracket and in the rear centre line bracket, respectively, and resting on the template corner locking clamps, h) securing an associated corner of the template to a respective template corner locking clamp by means passing through the slotted arm and engaged within a preselected relevant datum aperture in the template, i) removing the centre line orientation cylinders and the centre line brackets, after the template has been so accurately-secured, j) providing a plurality of grid orientation cylinders, each the grid orientation cylinder including an upper barrel, at least one orientatable slot in the upper barrel, and having means for removably-disposing the grid orientation cylinders in preselected datum apertures in the template, and inserting the grid orientation cylinders in the preselected datum apertures in the template, k) providing a plurality of grid support members, each grid support member including means to secure it to a rail of the universal press frame, and a longitudinally-extending slot in its upper end, and disposing the grid support members in spaced-apart orientation along the interior periphery of the universal press frame on the side rails, on the front rail and on the rear rail, respectively, 1) providing a plurality of jogger members, each jogger member comprising a base member and means for insertion in the dovetail groove of the rails, an adjustable support member which is adjustably-slidably-disposed with respect to the base member, and a guiding member having an upper edge and a lower edge, the depending guiding member being secured to one face of the adjustable support member to provide a depending guiding face, the jogger member also including slidable captive cap means having a leading edge, the slidable captive cap means being slidably-secured to the depending guiding member, disposing the jogger members in spaced-apart orientation along the interior periphery of the universal press frame on the side rails, on the front rail and on the rear rail, adjusting the plurality of jogger members until the depending guiding faces of the jogger members abut selected edges of the periphery of the template, the abutted guiding faces of the depending guiding members, together with the template, thereby constituting a perimeter that is substantially-identical to the outer perimetrical shape of a sheet containing a plurality of carton blanks which have been die-cut from a sheet by a male cutting die of the die cutting machine, and disposing the leading edge of the slidable captive cap means a predetermined cantilevered distance over the depending guiding face of the depending guiding member, the leading edges of the slidable captive cap means which are atop the depending guiding members thereby extending as far as an "imaginary" perimeter which would be defined by joining the leading edges of the slidable captive cap means which constitutes a perimeter that is substantially-similar to, but is slightly larger than, the perimetrical shape of a sheet containing the carton blanks which have been die-cut by the male cutting die of the die cutting machine, so that the slidable captive cap means provide a temporary support for selected areas of the sheet containing the carton blanks which have been die-cut from a sheet by the male cutting die of the die cutting machine, m) providing a plurality of auxiliary adjustable support members, each auxiliary adjustable support table comprising a base member for securement to the side rails, to the front rail and to the rear rail of the universal press frame, and an auxiliary adjustable support table, the auxiliary adjustable support table being adjustably-slidably-disposed along a longitudinal axis of the base member, securing the auxiliary adjustable support members in spaced-apart orientation along the interior periphery of the universal press frame, along the side rails, along the front rail and along the rear rail by cooperation with the dovetail groove in the rails, and adjusting the auxiliary adjustable support members with respect to the base member to have the leading edge oriented substantially-parallel to a part of the universal press frame to which the support member is secured, in such a way that an "imaginary" perimeter which would be defined by joining the front edges of the auxiliary adjustable support members constitutes a perimeter that is substantially-similar to, but is slightly larger than, the perimetrical shape of a sheet containing carton blanks which have been die-cut from a sheet by the male cutting die of the die cutting machine, so that the auxiliary adjustable support members provide a temporary support for selected areas of the sheet containing carton blanks which have been die-cut from a sheet by the male cutting die of the die cutting machine, n) providing a grid comprising a plurality of intersecting longitudinal and transverse rails, the intersecting rails coinciding with abutting portions of the plurality of cartons which have been die-cut from a sheet by a male cutting die of the die cutting machine, disposing the grid in selected slots in the grid orientation cylinders atop the template and in the slots in the grid support members, in order accurately to position the grid in the universal press frame, securing longitudinal and transverse projecting portions of the grid which are disposed in the slots in the grid support members in fixed position in the slots, and then securing the grid support members in locked position on the interior perimeter of the universal press frame, thereby accurately to fix the grid to the universal press frame, o) removing the securing means of the template to the template corner locking clamps and removing the template corner locking clamps, thereby allowing the template to drop freely below the fixed grid and below the universal press frame, and p) removing the template from below the universal press frame, thereby providing the female blanking die for the die cutting machine.

By a first variant of the third to seventh broad aspects of this invention, the method includes providing the grid orientation cylinders with a pair of mutually-transverse upper slots of different widths to accommodate a grid whose grid rails are of a different thickness.

By an eighth broad aspect of this invention, a universal press frame is provided for use in the setting-up of a female blanking die, as described hereinabove, for a die cutting machine for die cutting and/or blanking a carton blank, the universal press frame comprising a rectangular framework comprising two opposed side rails, a front rail, a rear rail and two side rails, the rails each being provided with a dovetail groove along its inside edge, the rectangular frame having a longitudinally-extending centre line which is marked on the front rail and on the rear rail, and particularly-specified datum lines which are marked on the side rails, four template corner locking clamps, each template corner locking clamp including means to secure it to a side rail of the universal press frame and a slotted inwardly-directed arm, each template corner locking clamp being secured to an associated side rail at the particularly-specified datum lines adjacent to the front rail and to the rear rail, with the slotted arm projecting into the interior area of the universal press frame, and a template, the shape of the template being of the outer shape of a sheet containing a plurality of cartons which have been cut by the die cutting machine, and also including thereon a centre line and other datum points for accurately-aligning the template within the universal press frame to provide a female blanking die, the template including centre line datum apertures along the centre line adjacent to the front end and to the rear end of the template and other datum apertures at the other datum points, the apertures including retention means within the apertures, and means, cooperating between the template and the template corner locking clamps, whereby the template is locked atop the template corner locking clamps, the template being locked atop the four template corner locking clamps at the precise location within the rectangular framework which has been predetermined so that the female blanking die and a male blanking die may be accurately aligned in the die cutting machine.

By a ninth broad aspect of this invention, a universal press frame is provided for use in the setting-up of a female blanking die, as described hereinabove, for a die cutting machine for die cutting and/or blanking a carton blank, the universal press frame comprising a rectangular framework comprising two opposed side rails, a front rail, a rear rail and two side rails, the rails each being provided with a dovetail groove along its inside edge, the rectangular frame having a longitudinally-extending centre line which is marked on the front rail and on the rear rail, and particularly-specified datum lines which are marked on the side rails, four template corner locking clamps, each template corner locking clamp including means to secure it to a side rail of the universal press frame and a slotted inwardly-directed arm, each the template corner locking clamp being secured to an associated side rail at the particularly-specified datum lines adjacent to the front rail and to the rear rail, with the slotted arm projecting into the interior area of the universal press frame, a template, the shape of the template being of the outer shape of a sheet containing a plurality of cartons which have been cut by the die cutting machine, and also including thereon a centre line and other datum points for accurately-aligning the template within the universal press frame to provide a female blanking die, the template including two longitudinally-spaced-apart apertures along the centre line adjacent to the front end and to the rear end of the template and other datum apertures at the other datum points, the apertures including retention means within the apertures, the underside of the template including a plurality of removably-secured foam plastic blocks, which are disposed in accurately-predetermined locations thereon, and means, cooperating between the template and the template corner locking clamps, whereby the template is locked atop the template corner locking clamps, the template being locked atop the four template corner locking clamps at the precise location within the rectangular framework which has been predetermined so that the female blanking die and a male blanking die may be accurately aligned in the die cutting machine, a plurality of jogger members, each jogger member comprising a base member and means for insertion in the dovetail groove of the rails, an adjustable support member which is adjustably-slidably-disposed with respect to the base member, and a guiding member having an upper edge and a lower edge, the guiding member being secured to one face of the adjustable support member to provide a depending guiding face, the plurality of jogger members being oriented along the interior perimeter of the rectangular framework in such a way that the depending guiding faces abut selected edges of the perimeter of the template, the abutted guiding faces of the depending guiding faces, together with the template, thereby constituting a perimeter that is substantially-identical to the outer perimetrical shape of a sheet containing a plurality of carton blanks which have been die-cut from a sheet by a male cutting die of the die cutting machine.

By a tenth broad aspect of this invention, a universal press frame is provided for use in the setting-up of a female blanking die, as described hereinabove, for a die cutting machine for die cutting and/or blanking a carton blank, the universal press frame comprising a rectangular framework comprising two opposed side rails, a front rail, a rear rail and two side rails, the rails each being provided with a dovetail groove along its inside edge, the rectangular frame having a longitudinally-extending centre line which is marked on the front rail and on the rear rail, and particularly-specified datum lines which are marked on the side rails, four template corner locking clamps, each template corner locking clamp including means to secure it to a side rail of the universal press frame and a slotted inwardly-directed arm, each the template corner locking clamp being secured to an associated side rail at the particularly-specified datum lines adjacent to the front rail and to the rear rail, with the slotted arm projecting into the interior area of the universal press frame, a template, the shape of the template being of the outer shape of a sheet containing a plurality of cartons which have been cut by the die cutting machine, and also including thereon a centre line and other datum points for accurately-aligning the template within the universal press frame to provide a female blanking die, the template including two longitudinally-spaced-apart apertures along the centre line adjacent to the front end and to the rear end of the template and other datum apertures at the other datum points, the apertures including retention means within the apertures, the underside of the template including a plurality of removably-secured foam plastic blocks, which are disposed in accurately-predetermined locations thereon, and means, cooperating between the template and the template corner locking clamps, whereby the template is locked atop the template corner locking clamps, the template being locked at the precise location within the rectangular framework which has been predetermined so that the female blanking die and a male blanking die may be accurately aligned in the die cutting machine, and a plurality of jogger members, each jogger member comprising a base member and means for insertion in the dovetail groove of the rails, an adjustable support member which is adjustably-slidably-disposed with respect to the base member, and a guiding member having an upper edge and a lower edge, the guiding member being secured to one face of the adjustable support member to provide a depending guiding face, the jogger member also including slidable captive cap means having a leading edge, the slidable captive cap means being slidably-secured to the depending guiding member, the jogger members being disposed in spaced-apart orientation along the interior periphery of the universal press frame on the side rails, on the front rail and on the rear rail, the plurality of jogger members being adjusted until the depending guiding faces of the jogger members abut selected edges of the periphery of the template, the leading edge of the slidable captive cap means being disposed a predetermined cantilevered distance over the depending guiding face of the depending guiding member, the plurality of jogger members being oriented along the interior perimeter of the rectangular framework in such a way that the depending guiding faces abut selected edges of the perimeter of the template, the abutted guiding faces of the depending guiding members, together with the template, thereby constituting a perimeter that is substantially-identical to the outer perimetrical shape of a sheet containing a plurality of carton blanks which have been die-cut from a sheet by a male cutting die of the die cutting machine, and the leading edges of the slidable captive cap means which are atop the depending guiding members thereby extending as far as an "imaginary" perimeter which would be defined by joining the leading edges of the slidable captive cap means which constitutes a perimeter that is substantially-similar to, but is slightly larger than, the perimetrical shape of a sheet containing the carton blanks which have been die-cut by the male cutting die of the die cutting machine, so that the slidable captive cap means provide a temporary support for selected areas of a sheet containing the carton blanks which have been die-cut from a sheet by the male cutting die of the die cutting machine.

By an eleventh broad aspect of this invention, a universal press frame is provided for use in the setting-up of a female blanking die, as described hereinabove, for a die cutting machine for die cutting and/or blanking a carton blank, the universal press frame comprising a rectangular framework comprising two opposed side rails, a front rail, a rear rail and two side rails, the rails each being provided with a dovetail groove along its inside edge, the rectangular frame having a longitudinally-extending centre line which is marked on the front rail and on the rear rail, and particularly-specified datum lines which are marked on the side rails, four template corner locking clamps, each template corner locking clamp including means to secure it to a side rail of the universal press frame and a slotted inwardly-directed arm, each the template corner locking clamp being secured to an associated side rail at the particularly-specified datum lines adjacent to the front rail and to the rear rail, with the slotted arm projecting into the interior area of the universal press frame, a template, the shape of the template being of the outer shape of a sheet containing a plurality of cartons which have been cut by the die cutting machine, and also including thereon a centre line and other datum points for accurately-aligning the template within the universal press frame to provide a female blanking die, the template including two longitudinally-spaced-apart apertures along the centre line adjacent to the front end and to the rear end of the template and other datum apertures at the other datum points, the apertures including retention means within the apertures, the underside of the template including a plurality of removably-secured foam plastic blocks, which are disposed in accurately-predetermined locations thereon, and means, cooperating between the template and the template corner locking clamps, whereby the template is locked atop the template corner locking clamps, the template being locked at the precise location within the rectangular framework which has been predetermined so that the female blanking die and a male blanking die may be accurately aligned in the die cutting machine, a plurality of grid orientation cylinders, each the grid orientation cylinder including an upper barrel, at least one orientatable slot in the upper barrel end, and having means for removably-disposing the grid orientation cylinders in preselected datum apertures in the template, and the grid orientation cylinders being disposed in the preselected datum apertures in the template, a plurality of grid support members, each grid support member including means to secure it to a rail of the universal press frame, and a longitudinally-extending slot in its upper end, the grid support members being disposed in spaced-apart orientation along the interior periphery of the universal press frame on the side rails, on the front rail and on the rear rail, respectively, a grid comprising a plurality of intersecting longitudinal and transverse grid rails, the intersecting grid rails coinciding with abutting portions of the plurality of cartons which have been die-cut from a sheet by a male cutting die of the die cutting machine, the grid rails being disposed in selected slots in the grid orientation cylinders atop the template and in the slots in the grid support members, in order accurately to position the grid in the universal press frame, longitudinal and transverse projecting portions of the grid rails which are disposed in the slots in the grid support members being secured in fixed position in the slots, and the grid support members being then secured in locked positions on the interior perimeter of the universal press frame, thereby accurately to fix the grid to the universal press frame, and a plurality of jogger members, each jogger member comprising a base member and means for insertion in the dovetail groove of the rails, an adjustable support member which is adjustably-slidably-disposed with respect to the base member, and a guiding member having an upper edge and a lower edge, the guiding member being secured to one face of the adjustable support member to provide a depending guiding face, the jogger members being disposed in spaced-apart orientation along the interior periphery of the universal press frame on the side rails, on the front rail and on the rear rail, the plurality of jogger members being adjusted until the depending guiding faces of the jogger members abut selected edges of the periphery of the template, the plurality of jogger members being oriented along the interior perimeter of the rectangular framework in such a way that the depending guiding faces abut selected edges of the perimeter of the template, the abutted guiding faces of the depending guiding members, together with the template, thereby constituting a perimeter that is substantially-identical to the outer perimetrical shape of a sheet containing a plurality of carton blanks which have been die-cut from a sheet by a male cutting die of the die cutting machine.

By a twelfth broad aspect of this invention, a universal press frame is provided for setting-up a female blanking die, as described hereinabove, for a die cutting machine for die cutting and/or blanking a carton blank, the universal press frame comprising a rectangular framework comprising a front rail, a rear rail and two side rails, the rails each being provided with a dovetail groove along its inside edge, the rectangular frame having a longitudinally-extending centre line which is marked on the front rail and on the rear rail, and particularly-specified datum lines which are marked on the side rails, four template corner locking clamps, each template corner locking clamp including means to secure it to a side rail of the universal press frame and a slotted inwardly-directing arm, each corner locking clamp being secured to an associated side rail adjacent to the front rail and adjacent to the rear rail at the particularly-specified datum lines, with the slotted inwardly-directing arm projecting into the interior area of the universal press frame, a template, the shape of the template being of the outer shape of a sheet containing a plurality of cartons which have been die-cut by the die cutting machine, and also including thereon a centre line and other datum points for accurately-aligning the template within the universal press frame to provide a female blanking die, the template including two longitudinally-spaced-apart apertures along the centre line adjacent to the front end and adjacent to the rear end of the template and adjacent other datum apertures of the other datum points, the apertures including retention means within the apertures, the underside of the template including a plurality of removably-secured foam plastic blocks, which are disposed in accurately-predetermined locations thereon, and means, cooperating between the template and the template corner locking clamps, whereby the template is locked atop the template corner locking clamps, the template being locked atop the four template corner locking clamps at the precise location within the rectangular framework which has been predetermined so that the female blanking die and a male blanking die may be accurately aligned in the die cutting machine, a plurality of grid orientation cylinders, each grid orientation cylinder including an upper barrel, at least one orientatable slot in the upper barrel end, and having means for removably-disposing the grid orientation cylinders in preselected datum apertures in the template, the grid orientation cylinders being inserted at predetermined accurate positions atop the template, a plurality of grid support brackets, each grid support bracket including means to secure it to a rail of the universal press frame, and a longitudinally-extending slot in its upper end, a grid support brackets being selectively-disposed along two opposed side rails, along the front rail and along the rear rail of the rectangular framework on the interior perimeter of the rectangular framework, a grid comprising a plurality of intersecting longitudinal and transverse grid rails, the intersecting grid rails coinciding with abutting portions of the plurality of cartons which have been die-cut from a sheet by a male cutting die of the die cutting machine, the grid rails being disposed in selected slots in the grid orientation cylinders atop the template and in the slots in the grid support brackets, the grid support brackets then being secured in locked positions on the interior perimeter of the universal press frame, when the grid is disposed in the slots in the grid support bracket, and a plurality of jogger members, which are selectively-disposed along the interior perimeter of the rectangular framework, each jogger member comprising a base member and means for insertion in the dovetail groove of the rails, an adjustable support member which is adjustably-slidably-disposed with respect to the base member, and a guiding member having an upper edge and a lower edge, the guiding member being secured to one face of the adjustable support member to provide a depending guiding face, the jogger member also including slidable captive cap means having a leading edge, the slidable captive cap means being slidably-secured to the depending guiding member, the jogger members being disposed in spaced-apart orientation along the interior periphery of the universal press frame on the side rails, on the front rail and on the rear rail, the plurality of jogger members being adjusted until the depending guiding faces of the jogger members abut selected edges of the periphery of the template, and the leading edge of the slidable captive cap means being disposed at a predetermined cantilevered distance over the depending guiding face of the depending guiding member, the plurality of jogger members being so oriented along the interior perimeter of the rectangular framework in such a way that the depending guiding faces abut selected edges of the perimeter of the template, the abutted guiding faces of the depending guiding members, together with the template, thereby constituting a perimeter that is substantially-identical to the outer perimetrical shape of a sheet containing a plurality of carton blanks which have been die-cut from a sheet by a male cutting die of the die cutting machine, and the leading edges of the slidable captive cap means which are atop the guiding members thereby extending as far as an "imaginary" perimeter which would be defined by joining the leading edges of the slidable captive cap means which constitutes a perimeter that is substantially-similar to, but is slightly larger than, the perimetrical shape of a sheet containing the carton blanks which have been die-cut by the male cutting die of the die cutting machine, so that the slidable captive cap means provide a temporary support for selected areas of the sheet containing the carton blanks which have been die-cut from a sheet by the male cutting die of the die cutting machine.

By a thirteenth broad aspect of this invention, a female blanking die, as described hereinabove, is provided for a die cutting machine for die cutting and/or blanking a carton blank, the universal press frame comprising a rectangular framework comprising a front rail, a rear rail and two side rails, the rails each being provided with a dovetail groove along its inside edge, the rectangular frame having a longitudinally-extending centre line which is marked on the front rail and on the rear rail, and particularly-specified datum lines which are marked on the side rails, four template corner locking clamps, each template corner locking clamp including means to secure it to a side rail of the universal press frame and a slotted inwardly-directing arm, each corner locking clamp being secured to an associated side rail adjacent to the front rail and to the rear rail at the particularly-specified datum lines, with the slotted inwardly-directing arm projecting into the interior area of the universal press frame, a template, the shape of the template being of the outer shape of a sheet containing a plurality of cartons which have been die-cut by the die cutting machine, and also including thereon a centre line and other datum points for accurately-aligning the template within the universal press frame to provide a female blanking die, the template including two longitudinally-spaced-apart apertures along the centre line adjacent to the front end and to the rear end of the template and other datum apertures of the other datum points, the apertures including retention means within the apertures, the underside of the template including a plurality of removably-secured foam plastic blocks, which are disposed in accurately-predetermined locations thereon, and means, cooperating between the template and the template corner locking clamps, whereby the template is locked atop the template corner locking clamps, the template being locked atop the four template corner locking clamps at the precise location within the rectangular framework which has been predetermined so that the female blanking die and a male blanking die may be accurately aligned in the die cutting machine, a plurality of grid orientation cylinders, each grid orientation cylinder including an upper barrel, at least one orientatable slot in the upper barrel, and having means for removably-disposing the grid orientation cylinders in preselected datum apertures in the template, the grid orientation cylinders being inserted at predetermined accurate positions atop the template, a plurality of grid support brackets, each grid support bracket including means to secure it to a rail of the universal press frame, and a longitudinally-extending slot in its upper end, the grid support brackets being selectively-disposed along two opposed side rails, along the front rail and along the rear rail of the rectangular framework on the interior perimeter of the rectangular framework, a grid comprising a plurality of intersecting longitudinal and transverse grid rails, the intersecting grid rails coinciding with abutting portions of the plurality of cartons which have been die-cut from a sheet by a male cutting die of the die cutting machine, the grid rails being disposed in selected slots in the grid orientation cylinders atop the template and in the slots in the grid support brackets, the grid support brackets then being secured in locked positions on the interior perimeter of the universal press frame by securing longitudinal and transverse projecting portions of the grid which are disposed in the slots in the grid support brackets in fixed position in the slots, a plurality of jogger members, each jogger member comprising a base member and means for insertion in the dovetail groove of the rails, an adjustable support member which is adjustably-slidably-disposed with respect to the base member, and a guiding member having an upper edge and a lower edge, the guiding member being secured to one face of the adjustable support member to provide a depending guiding face, the jogger member also including slidable captive cap means having a leading edge, the slidable captive cap means being slidably-secured to the depending guiding member, the jogger members being disposed in spaced-apart orientation along the interior periphery of the universal press frame on the side rails, on the front rail and on the rear rail, the plurality of jogger members being adjusted until the depending guiding faces of the jogger members abut selected edges of the periphery of the template, and the leading edge of the slidable captive cap means being disposed at a predetermined cantilevered distance over the depending guiding face of the depending guiding member, the plurality of jogger members being so oriented along the interior perimeter of the rectangular framework in such a way that the depending guiding faces abut selected edges of the perimeter of the template, the abutted guiding faces of the depending guiding members, together with the template, thereby constituting a perimeter that is substantially-identical to the outer perimetrical shape of a sheet containing a plurality of carton blanks which have been die-cut from a sheet by a male cutting die of the die cutting machine, and the leading edges of the slidable captive cap means which are atop the depending guiding members thereby extending as far as an "imaginary" perimeter which would be defined by joining the leading edges of the slidable captive cap means which constitutes a perimeter that is substantially-similar to, but is slightly larger than, the perimetrical shape of a sheet containing the carton blanks which have been die-cut by the male cutting die of the die cutting machine, so that the slidable captive cap means provide a temporary support for selected areas of the sheet containing the carton blanks which have been die-cut from a sheet by a male cutting die of the die cutting machine, and a plurality of auxiliary adjustable support members, each of the auxiliary adjustable support members comprising a base member for securement to the rectangular framework, and an auxiliary adjustable support table being slidably-adjustably-disposed along a longitudinal axis of the base member, the auxiliary adjustable support table being secured in spaced-apart orientation along the interior periphery of the universal press frame, along the side rails, along the front rail and along the rear rail by cooperation with the dovetail groove in the rails, the auxiliary adjustable support tables being adjusted with respect to the base member to have the leading edge oriented substantially-parallel to a part of the universal press frame to which the auxiliary adjustable support members is secured, in such a way that an "imaginary" perimeter which would be defined by joining the front edges of the auxiliary adjustable support tables constitutes a perimeter that is substantially-similar to, but is slightly larger than, the perimetrical shape of a sheet containing carton blanks which have been die-cut from a sheet by the male cutting die of the die cutting machine, so that the auxiliary adjustable support tables provide a temporary support for selected areas of the sheet containing carton blanks which have been die-cut from a sheet by a male cutting die of the die cutting machine.

By a variant of the eighth to thirteenth broad aspects of this invention, the universal press frame includes legs which are secured to selected the rails, to support the universal press frame above a base support.

By a fourteenth broad aspect of this invention, a method is provided for setting-up a male blanking die and a female blanking die combination in a blanking station of a die cutting machine, the method comprising the steps of A) providing a male blanking die by the steps comprising a) providing a template, the shape of the template being of the outer shape of a sheet containing cartons which have been die-cut by the die cutting machine, the template also including a plurality of selected apertures in the template, the underside of the template including a plurality of removably-secured foam plastic blocks which are disposed in accurately-predetermined locations thereon, and b) installing the template in the die cutting machine with the foam plastic blocks facing downwardly, the template being accurately-installed through the use of the selected apertures in the template, thereby providing a male blanking die as an upper blanking die in the die cutting machine, and B) providing a female blanking die by the steps, as described hereinabove, and then c) using the removed template as the template in step A), thereby simultaneously also providing the female blanking die for the die cutting machine, and d) installing the female blanking die as the fixed lower blanking die in the die cutting machine.

As noted hereinabove, the method of one important embodiment of this invention provides methods for erecting a female blanking die in the form of a grid support frame which is accurately-positioned within the universal press frame which includes a front rail, a rear rail and two side rails, the side rails each being provided with a dovetail groove along its inside edges. The female blanking die is accurately-positioned within the universal press frame by means of method steps involving the use of a template which had been laser-shaped corresponding to the outer perimetrical shape of a sheet, containing a plurality of cartons which are to be die-cut by the male cutting die of the die cutting machine. The perimetrical edges of the lasered template are used to define the extent to which jogger members which, according to this method, are placed on the rails so as to project inwardly within the interior perimeter of the rectangular framework of the universal press frame. The perimetrical shape of the template and the rectangular apertures therethrough, are produced according to the instructions of a CAD program and then are laser cut. The outer perimeter of the template is 1/32" outside of the carton cut lines which have been accurately-laser-etched into the template according to the instructions of the CAD program. The inside laser-etched lines are on-size to match the outer perimetrical shape of the cartons to be die-cut by the die press. Datum holes are laser-cut in the template in precise locations according to the instructions of the CAD program. A lasered centre line is placed on the template, and centre line holes are cut in the template. "T"-nuts are secured within the centre line holes, and the bases of the centre line orientation cylinders are threaded into the "T"-nuts in these centre line holes. Thus, the centre line orientation cylinders are inserted at the front end centre line hole and at the rear end centre line hole, and a steel rod is inserted through aligned bores in the upper barrels of the centre line orientation cylinders. Centre line brackets are secured onto the front rail and the rear rail at the exact centre line, by having the extended ends of the steel rod rest on the cradles provided by the centre line brackets. The template is temporarily, but securely, fixed to the frame by means of engagement with corner locking clamps which are disposed at the corners of the two opposed side rails of the universal press frame. Once the template is accurately-placed and fixed within the frame, the centre line orientation devices and the centre line brackets are removed. The template is, thus, on the centre line of the universal press frame. It is adjusted longitudinally to datum positions which have been previously-designated according to the instructions of the CAD program, with respect to the side rails, these datum positions being defined by holes in the template which are provided with "T"-nuts. This provides a rigid, stable combination of the universal press frame and the template. Etch lines are provided on the template in the shape of the abutting edges of cartons which are to be blanked. A suitable number of datum holes are provided on each of the etch lines, and "T"-nuts are secured within such datum apertures. Grid orientation devices in the form of cylinders including an upper barrel having a pair of mutually-transverse slots of different widths in its upper circular face and a threaded shank at the base thereof, are threaded into the "T"-nuts in the grid orientation datum apertures. These grid orientation cylinders are used to fix the location of the female blanking die grid. A plurality of grid support brackets are disposed along the inner perimeter of the frame.

The grid, in the shape of the outline of each of the abutting portions of the plurality of cartons to be die-cut, (and which forms the female blanking die) is placed atop the template to fit into selected slots within the grid orientation cylinders, and into slots in grid support brackets which are also disposed along the internal periphery of the universal press frame. The barrels of the orientation cylinders are rotated so that the grid fits onto the slots of the grid orientation cylinders, and then the grid orientation cylinders are locked into the template by means of the lock washers. The ends of the grid are locked to respective grid support brackets by a lock screw, and the grid support brackets are then slid along the universal press frame to the proper position according to the instructions of the CAD program. The grid support brackets are then locked in accurate positions on the universal press frame, dependent on the accurate location of the grid. In this way, the grid is placed in the perfect position according to the instructions of the CAD program for accurate positioning of the female blanking die.

The jogger members, which include a particular expandable dovetail-lock for insertion in the dovetail groove of the side rails, are now accurately-positioned around the inner perimeter of the universal press frame. Some or all of the jogger members may have been previously-placed around the inner perimeter of the universal press frame, before the template is secured therein. If not, then all the jogger members are so-placed at this time. In any event, all of the jogger members which are selectively-disposed along the inner perimeter of the rectangular framework of the universal press frame are adjusted to abut selected perimetrical edges of the lasered template. In this way, the jogger members are thereby accurately-positioned.

If the back trim of the die-cut sheet containing the plurality of cartons has been removed by the stripper, the jogger members are adjusted to abut the back of the lasered template. If the side trim of the die-cut and blanked sheet containing the plurality of cartons have been removed by the stripper, then side rails are inserted into slots in the side jogger members. Alternatively, the side rails may be inserted into special side support brackets. In either case, they are secured therein with lock-down bolts. This provides support for the side edges of the blanked sheet.

The front end of the blanked sheet is associated with a gripper. The front trim is removed to provide the means to pull the blanked sheets through the press. Special front rail jogger members assure that the front end of the blanked sheet is accurately-positioned.

The template is then removed by the removal of the lock screws holding the template to the corner locking clamps. The corner locking clamps are then removed, thereby allowing the template to drop down below the universal press frame. Then, the template is then removed from underneath the universal press frame. The entire female blanking die and universal press frame is ready for mounting, as the lower plate (female blanking die) of the blanking machine, and is ready for production.

By these means, the entire female blanking die, which includes the grid, the jogger members and optional auxiliary adjustable support members, is built-up. The template assures that the cut sheet is exactly-matched, and that the universal press frame is square. The female blanking die can be fixed in the press in registry with all of the datum points, which are predetermined according to the instructions of the CAD program.

The die-cut sheet is supported on the grid (the female blanking die) and on the front trim support, and, optionally, also on the side support rails. The jogger members are adjusted (i.e., "fine-tuned") to position them to contact the perimeter of the template. The front rail joggers are adjusted (i.e., "fine-tuned") by longitudinal movement to provide the proper set-up for the shear distance in order to break the nicks in the blank.

The removed template now becomes the male blanking die by the following steps. The grid orientation cylinders are removed from the upper surface of the template. The lower surface of the template is provided with a plurality of foam plastic blocks, which are removably-secured to the underside of the template. These blocks may be removably-held by means of holding members, e.g., cylindrical members, "T"-shaped members, or "V"-shaped members, which are secured to the underside of the template. Some or all of these foam plastic blocks may be split longitudinally, so that the two portions may be slid along the holding members to "fine-tune" their position, as will be explained further hereinafter. The template is then secured, in the usual fashion, to the die cutting machine by means well-known in the art. Such securement is, however, very accurate and is in registry with the lower female blanking die, through the use of the datum holes from which the grid orientation cylinders have been removed. The foam plastic blocks are adapted to contact the blanked cartons in a manner which does not damage the cartons when the blanked-out cartons are removed from the die-cut sheets.

DESCRIPTION OF THE DRAWINGS

In the accompanying drawings,

As seen in FIG. 1 and FIG. 3, a template 100 is provided which has a peripheral outline 101 which coincides with, but is slightly larger than, the outer periphery of a plurality of abutting cartons which have been die cut from a sheet. The template 100 is also provided with a plurality of generally-rectangular holes 102, below which are a plurality of foam plastic blocks 103 which are removably-secured to the bottom surface of the template 100.

Figure 1:
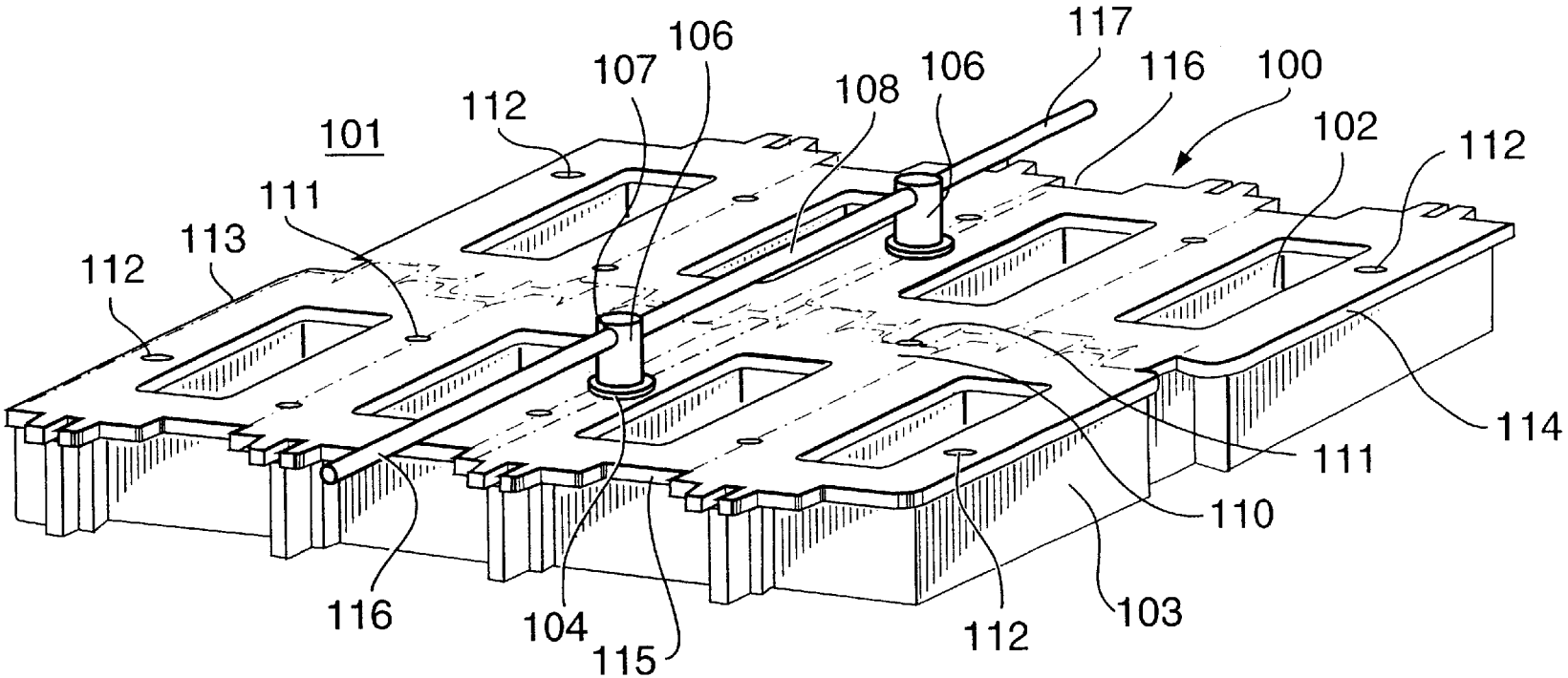
FIG. 1 is a perspective view of a template to which centre line orientation cylinders and a centre line cylindrical rod have been attached.

The template 100 is provided with a plurality of apertures within which are secured "T"-nuts. One series of such apertures are two centre line apertures 104. A centre line orientation cylinder 106, to be fully-described hereinafter, is removably-secured in each of these "T"-nuts in these apertures 104. The through bores 107 in the centre line orientation cylinders 106 are aligned, and a centre line cylindrical rod 108 is urged therethrough.

The upper surface of the template 100 is provided with a lasered outline 110 which coincides with the inner abutted edges of the plurality of cartons which have been die cut from a sheet. The second set of apertures 111 is placed strategically along that lasered outline 110. These apertures are each fitted with the "T"-nuts.

The third set of such apertures 112 comprises four apertures, two of which are placed along each of the side edges 113,114 of the template 100, adjacent to the front edge 115 and to the rear edge 116. This set of apertures 112 is also fitted with the "T"-nuts.

The purpose of the second and third sets of apertures will be fully described hereinafter.

Figure 2:
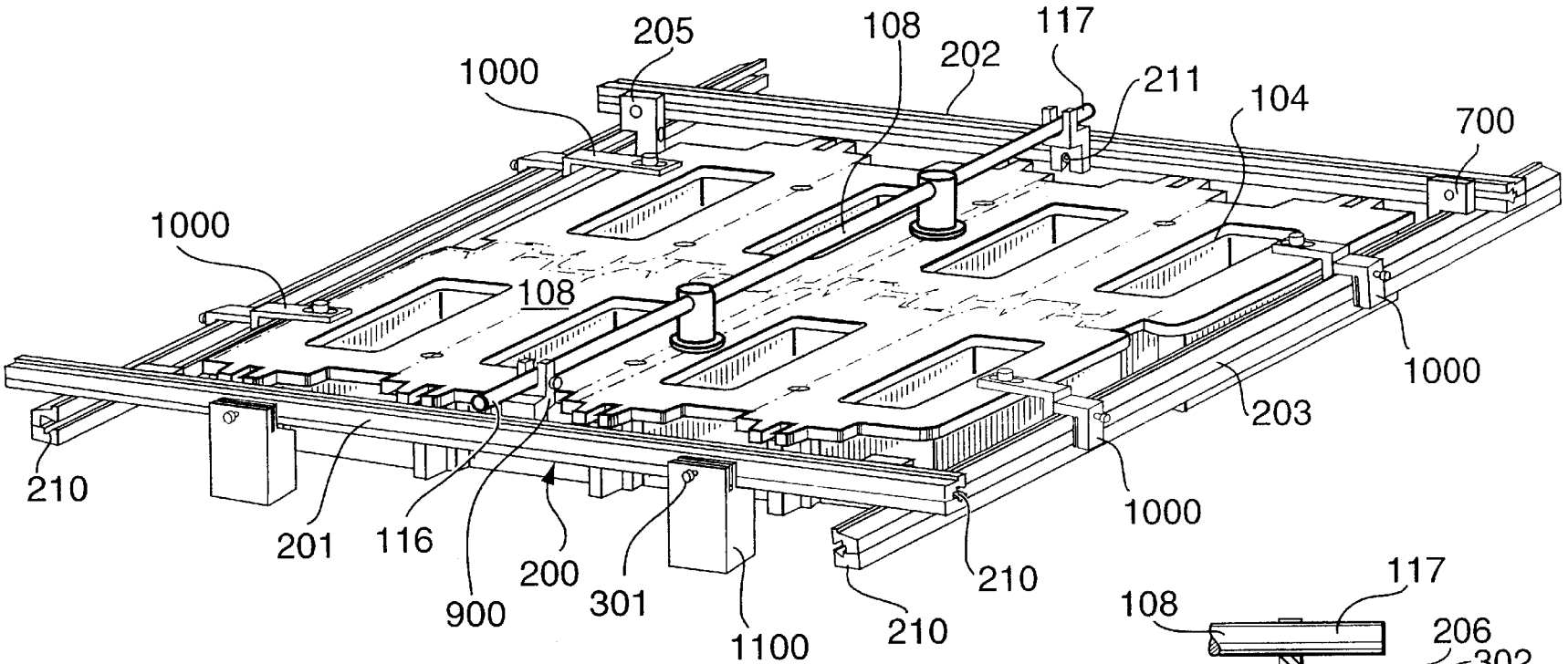
FIG. 2 is a perspective view of a universal press frame into which the template of FIG. 1 has been introduced.
Figure 3:
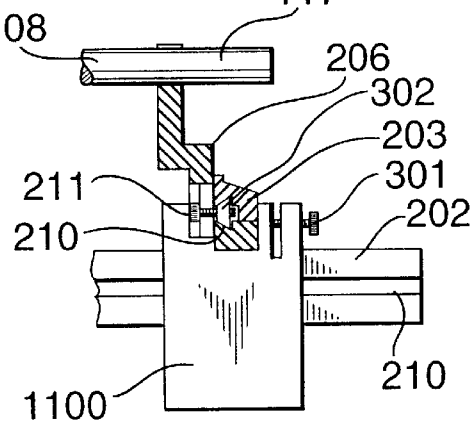
FIG. 3 is a partial, enlarged section along the line 3—3 of FIG. 2.

As seen in FIG. 2 and FIG. 3, a universal press frame 200 is provided, which is constituted by a front rail 201, a rear rail 202, and two side rails 203,204. Each such rail is provided with a dovetail groove 210. The side rails 203,204 are each secured at right angles to the front rail 201 and to the rear rail 202, by means of four rail clamps 700, whose structure will be fully described hereinafter. The rail clamps 700 are secured to the rails by means of suitable bolts, which are threaded into trapezoidal nuts which are placed in the dovetail groove 210 in the rails.

The first step in the actual erection of the female blanking die 600 involves the placement of the centre line clamps 206 on the front rail 201 and on the rear rail 202, and the securement of such centre line clamps 206 at the precise centre point (not seen) which has been marked on the front rail 201 and on the rear rail 202. These centre line clamps 206 will be described in greater detail hereinafter.

The next step in the actual erection of the female blanking die 600 involves the placement and the securement of the legs 1100 onto the universal press frame 200, namely two legs 1100 on the front rail 201 and two legs 1100 on the rear rail 202. These legs 1100 will be described hereinafter.

The next step in the actual erection of the female blanking die 600 involves placing the template 100, as shown in FIG. 1, within the universal press frame 200 by having the projecting ends 117 of the centre line cylindrical rod 108 on cradles which are provided in the centre line clamps 206. This places the template 100 exactly within the center of the universal press frame 200 in such a manner that it cannot be moved transversely, but it can be moved longitudinally. Then, four template corner clamps 1000, whose structure will be fully described hereinafter, are secured, two to each of the side rails 203,204, at the precise points on those rails which have been defined by a CAD program. These template corner clamps 207 will be described hereinafter. The template 100 is then moved longitudinally so that the third set of apertures 112 in the template 100 are aligned with the slots in the template corner clamps 1000. Then, suitable bolts 208, e.g., Allen-head bolts, are inserted through the slots in the template corner clamps 1000, to secure the template 100 in the exact position, as required by the CAD program, within the universal press frame 200. This places the template 100 in the exact position for the erection of the female blanking die 600. The intermediate structure so-provided is rigid, and is perfectly square and since the template 100 is perfectly sited within the universal press frame 200, it can be used as the basis for the erection of the female blanking die 600.

FIG. 3 shows in detail some of the assembly details of this intermediate structure which has been provided by the steps described in respect to FIG. 2. The side rail 203 is placed in a longitudinal groove within the leg 1100. The rail 203 is secured therein by means of compressive force applied to a resiliently-deflectable wall of the leg 1100 against the rail 203 by means of screwing in of a suitable bolt 301, e.g., an Allen-head bolt. The centre line clamp 206 is secured to the front rail 201 or to the rear rail 202 by means of a suitable bolt, e.g., an Allen-head bolt, 211, which is screwed into a trapezoidal nut 302 which is placed within the dovetail groove 210 in the side rail 203. The end 117 of the centre line cylindrical rod 108 rests within an upper cradle of the centre line clamp 206.

Since, as described above, the template 100 is now accurately-and rigidly-fixed within the universal press frame 200 by means of the template corner clamps 1000, the centre line clamps 206, the centre line cylindrical rod 108 and the centre line orientation cylinders 106 are no longer required. Consequently, as shown in FIG. 4, the centre line cylindrical rod 108 has been removed, the centre line orientation cylinders 106 have been unscrewed from the "T"-nuts in the template 100, and the centre line clamps 206 have been removed by unscrewing the suitable bolt 211, e.g., the Allen-head bolt, which is screwed into the trapezoidal nut 302 which is placed within the dovetail groove 210 in the rails.

Figure 4:
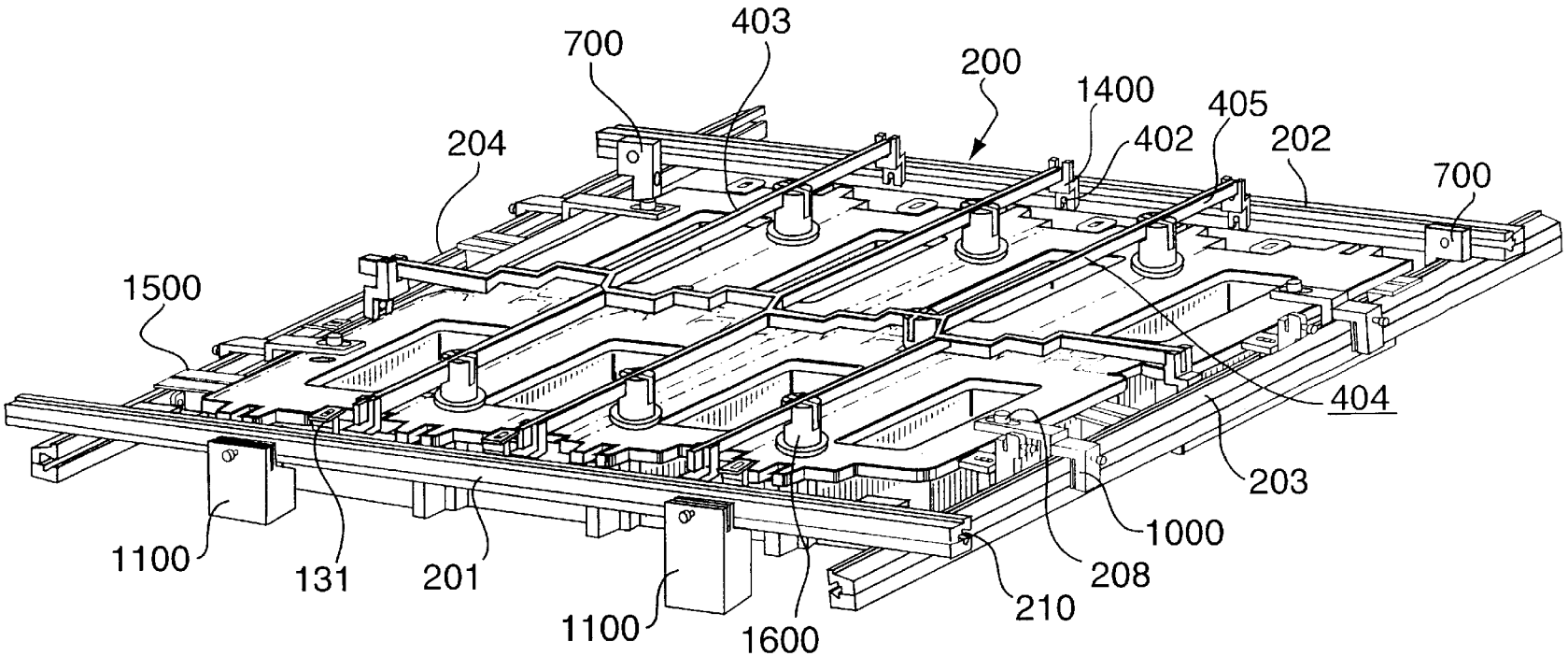
FIG. 4 is a perspective view of the universal press frame/template combination generally shown in FIG. 2, but on which all the elements necessary to produce the female blanking die have been added.

The next step in the actual erection of the female blanking die 600 is also shown in FIG. 4. A plurality of grid orientation brackets 1400 (which will be fully described hereinafter) are placed loosely along the perimeter of the universal press frame 200 which is defined by the four rails 201,202,203,204. This placement is by means of suitable bolts, e.g. Allen-head bolts, 402, which are screwed into trapezoidal nuts which are placed within the dovetail grooves 210 in the rails. A plurality of grid orientation cylinders 1600 (which will be described hereinafter) are placed in the second set of "T"-nut-fitted apertures 111. This enables a grid 404, which is shaped to coincide exactly with the inner abutted edges of the plurality of cartons which have been die cut from a sheet, to be placed within the upper aligned grooves in the grid orientation cylinders 1600 and in the grid orientation brackets 1400. The grid orientation brackets 1400 may be slid along the respective rail to enable engagement with the free ends of the rails 405 constituting the grid 404. Then, the grid orientation brackets 1400 are locked in that position on the respective rails. This step assures that the grid 404 is locked into place in the exact position, as defined by the CAD program, within the universal press frame 200.

Figure 5:
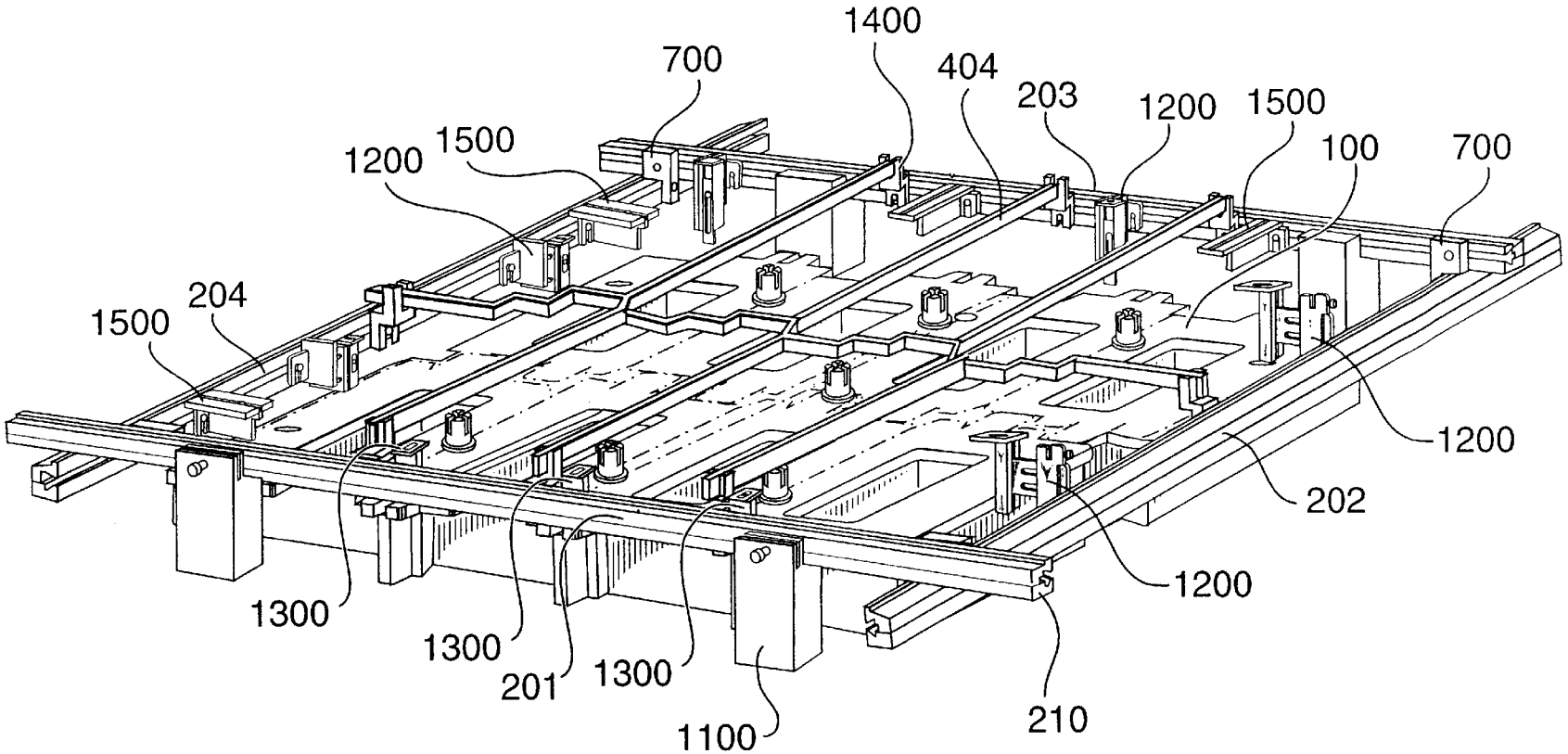
FIG. 5 is a perspective view of the combination generally as shown in FIG. 4, but wherein the template and the elements attached thereto have been dropped below the universal press frame and the elements which are attached to the universal press frame.

As seen in FIG. 5, a plurality of side and rear rail jogger members 1200 (which will be fully described hereinafter) are secured at selected positions to the side and rear rails. They are then adjusted so that their guiding surfaces abut selected portions of the side and rear edges of the template 100, and so that slidable caps of the jogger members are slightly further into the central area of the universal press frame 200, than the guiding surfaces thereof.

A plurality of front rail jogger members 1300 (which will be fully described hereinafter) are secured at selected positions to the front rail 201. They are then adjusted so that their guiding surfaces abut selected portions of the front edge of the template 100, and so that slidable caps thereof are slightly further into the central area of the universal press frame 200, than the guiding surfaces thereof.

A plurality of auxiliary support members 1500 (which will be fully described hereinafter) are secured at selected positions to the side and rear rails. They are then adjusted so that the slidably-adjustable table thereof extends slightly further into the central area of the universal press frame 200, than the respective peripheral edges of the template 100.

FIG. 5 also shows the next step in the actual erection of the female blanking die 600. In this step, the suitable bolts 208, e.g., Allen-head bolts, holding the template 100 to the template corner clamps 1000 have been removed, which allows the template 100 to fall below the universal press frame 200 to the level which is defined by the bottom of the legs 1100. The grid orientation cylinders 1600 have also been removed from the template 100. In addition, the template corner clamps 1000 have been removed from the side rails 203,204.

Figure 6:
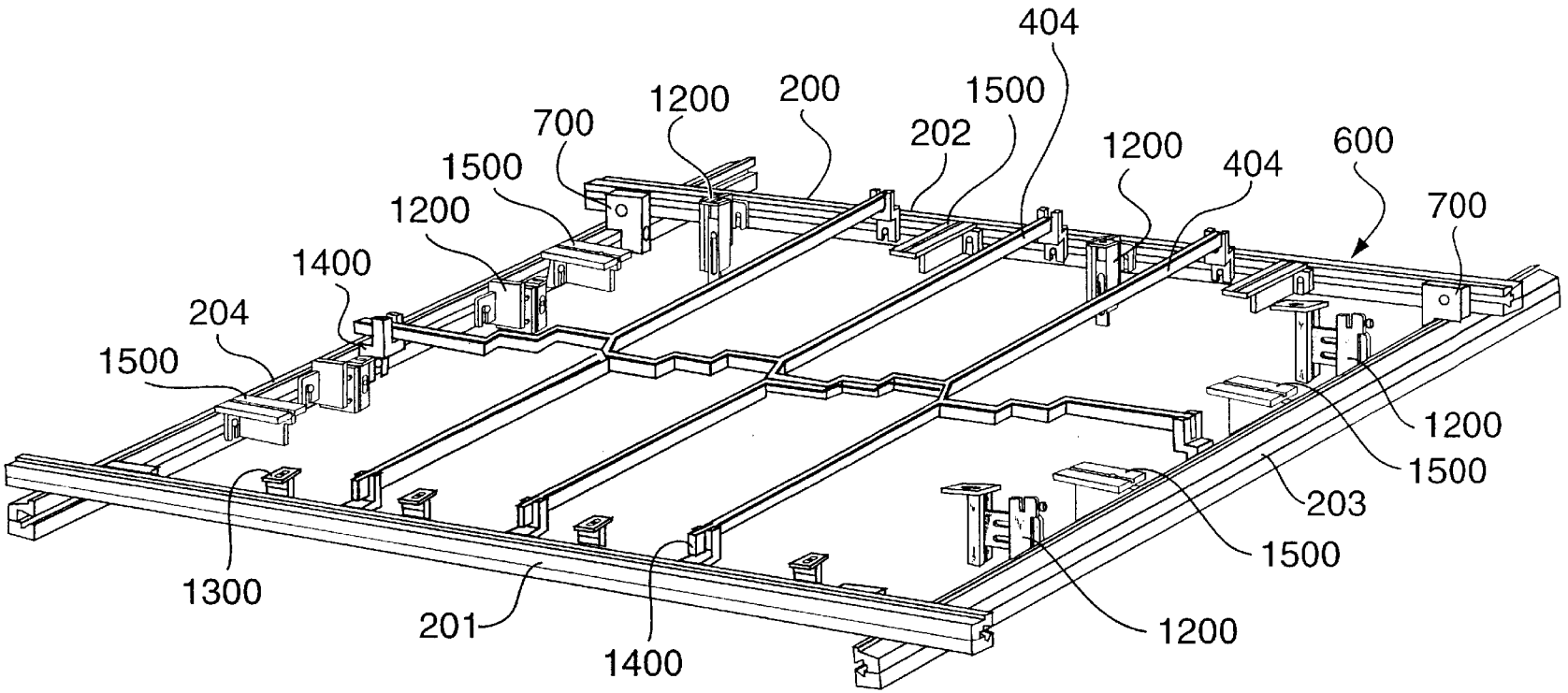
FIG. 6 is a perspective view of the female blanking die.

FIG. 6 shows the finally-erected female blanking die 600. The female blanking die 600 thus comprises the universal press frame 200, to which are secured the grid orientation brackets 1400 which secure the grid 404 to the universal press frame 200. The universal press frame 200 is fitted with the plurality of side and rear rail jogger members 1200, the plurality of front rail jogger members 1300 and the plurality of auxiliary support members 1500. It is noted that the legs 1100 have been removed.

To recapitulate, in narrative terms, first, a universal press frame is assembled as a rectangular framework of two side rails, a front rail and a rear rail. Each rail includes an internal dovetail groove. The side rails are sited at a higher vertical level than the front rail and the rear rail.

The four template corner clamps are secured to the side rails, i.e., two on each side rail adjacent to the front rail and to the rear rail, situated on the side rails at particular datum points which have been defined by a CAD program to dispose a template in the exact location within the universal press frame.

Then a centre line bracket is mounted on each of the front rail and of the rear rail, at the precise centre point of such rails.

A template, whose perimetrical shape coincides with the outer peripheries of a plurality of cartons which are to be die cut from a sheet, is however, slightly larger than those peripheries. The template is provided with a centre line which is laser-etched thereon, and with a front centre line aperture and a rear centre line aperture on that lasered centre line. These centre line apertures are each fitted with a "T"-nut. The template is further provided with a laser-etched pattern, which corresponds with the exact internal butted peripheries of the cartons which are to be die cut from a sheet. A plurality of grid orientation apertures are strategically-formed along the laser-etched pattern, and a "T"-nut is fitted into each of such grid orientation aperture.

A front and a rear centre line cylinder, each having an upper barrel which is provided with a circular through hole is secured to the front and to the rear centre line apertures, respectively. The circular through holes are lined-up and a cylindrical rod is passed therethrough. The template can then be picked up, using the cylindrical rod as a "handle" and can be placed within the universal press frame, resting loosely on the four template corner lock clamps and with the ends of the cylindrical rod resting in cradles which are defined by the upper ends of the centre line brackets. This prevents the template from transverse movement. However, the template can be moved longitudinally until the position-designating apertures in the template are aligned within the slots in the template corner locking clamps. A suitable screw is then inserted through each slots and onto each respective position-designating aperture. This locks the template in the "perfect" position within the universal press frame. Subsequently, the cylindrical rod is removed, the centre line cylinders are removed from the template and the centre line brackets are removed from the universal press frame.

Now, a plurality of grid orientation cylinders are secured within the grid orientation apertures on the template. A plurality of grid orientation brackets is disposed along the periphery of the universal press frame. A grid, whose outline coincides with the abutting edges of the plurality of blanks to be die cut from a sheet, is placed within suitably-orientated slots in the grid orientation cylinders and in the grid orientation brackets. The ends of the grid, which are within the slots in the grid orientation brackets, are secured to their respective bracket. Then, the brackets, which were moved along the rail in order to have their slots aligned with the grid, are secured at those locations on the universal press frame.

Once this is done, the template is removed by disengaging the screws holding the template to the template corner clamps, and the suitable bolts holding the template corner clamps to the rails. This enables the template to be dropped down below the universal press frame. It is preferred that the universal press frame be provided with legs to limit the extent of the drop.

The legs are removed, and the universal press frame so-provided is secured to a lower platten of a die cutting machine. By these means, the universal press frame becomes the female blanking die, wherein the grid provides a "table" which temporarily supports the die cut cartons, but which enable such cartons to be pushed through the apertures which are defined by the grid.

The male blanking die is provided from the template. The description of converting the template to the male blanking die is completely described in the above-identified co-pending Canadian Patent Application No. 2,259,785 and so need not be further described here. Nevertheless for the purpose of completeness, such conversion may be described as follows. The template, which has had the cylindrical devices removed from the upper surface thereof, is now placed against the upper (movable) plates of the die cutting machine by means of being accurately-positioned with screws fitted into the apertures from which the cylindrical members have been removed. The foam plastic blocks are each shaped to coincide with the shape of the blanked carton. During the movement of the male blanking die, the blocks push the blanked cartons through the apertures.

The description of the foam plastic blocks is given in the above-identified co-pending Canadian Patent Application No. 2,259,785, and so need not be further described here. Nevertheless, as described on such co-pending Canadian Patent Application, the foam plastic blocks may be as unitary blocks, or at least some of the foam plastic blocks divided transversely into two longitudinally slidable blocks. These sub-divided foam plastic blocks may be slid longitudinally in order to adjust the offset between the foam blocks and the openings in the female blanking die. This, thereby, enables adjustment of the shear for breaking the nicks in the sheet containing the plurality of carbon blanks which have been die-cut by the die cutting machine.

The following description now provides a full detailed description of the essential components which are used for the setting-up of the female blanking die of aspects of this invention.

Figure 7:
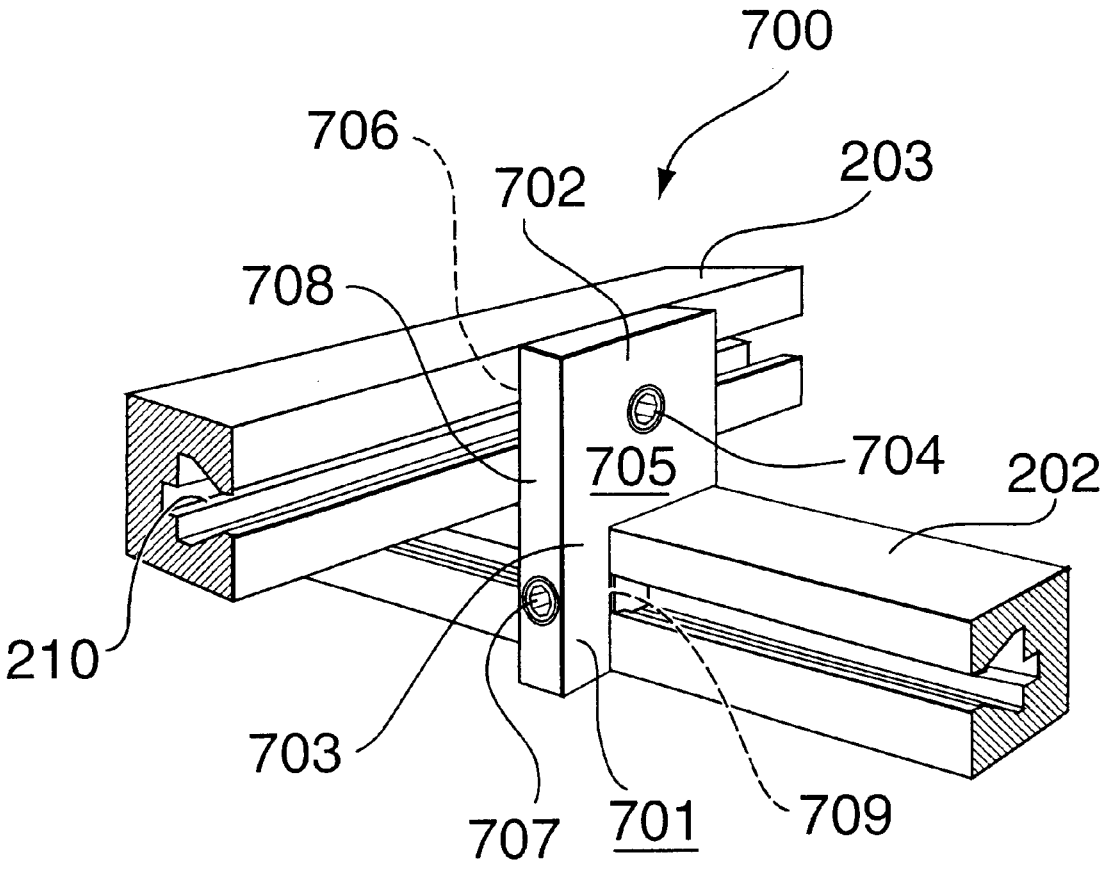
FIG. 7 is a perspective view of the clamp which clamps two mutually-perpendicular rails together.

The rail connector element 700 is shown in perspective view in FIG. 7. The rail connector element 700 is a generally inverted "L"-shaped member 701 including an upper reposed leg block 702 and a lower upright leg block 703.

Reposed upper leg block 702 includes a through hole 704 extending from its front face 705 to its rear face 706. Lower upright leg 703 includes a through hole 707 extending from its inner end face 708 to its inner end face 709.

In use, block 700 is placed at the inner intersection of, e.g., a rear rail 202 and a side rail 203, with the inner face 709 of the lower leg block 703 against the dovetail groove 210 in the rear rail 202, and with the inner face 706 of the upper repose block 702 against the dovetail groove 210 in the side rail 203. A suitable bolt, e.g., an Allen-head bolt, is inserted through the through hole 707 and is threaded into a trapezoidal nut which is inserted in the dovetail groove 210 in the rear rail 202. Similarly, a suitable bolt, e.g., an Allen-head bolt, is inserted through the through hole 704 and is threaded into a trapezoidal nut which is inserted in the dovetail groove 210 in side rail 203. Complete tightening of the suitable bolts, e.g., the Allen-head bolts, firmly secures the rear rail 202 to the side rail 203.

In a similar fashion, the remaining three intersecting corners are locked together.

This provides a complete, rigid rectangular frame constituting the universal press frame of the required dimensions.

Figure 8:
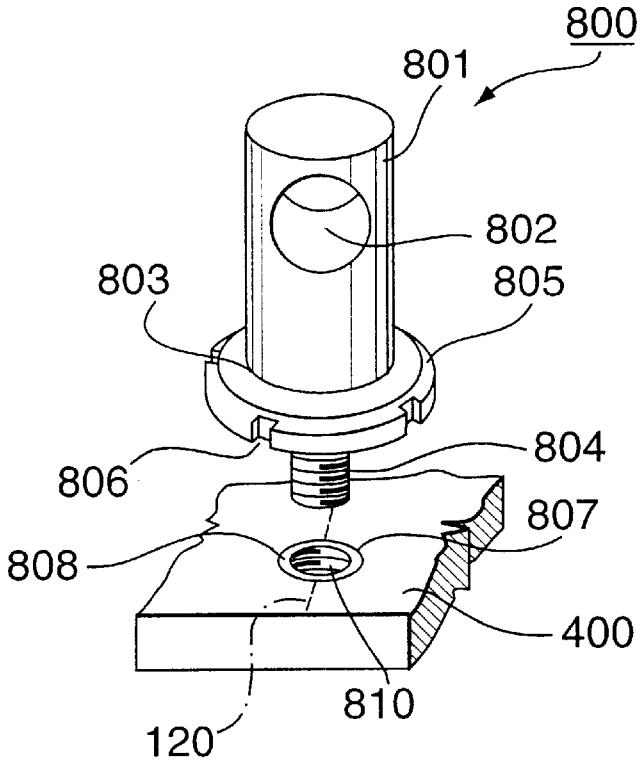
FIG. 8 is a perspective view of a centre line orientation cylinder about to be inserted in the "T"-nut which is secured within an aperture in the template.

FIG. 8 shows, in perspective, an embodiment of a centre line orientation cylinder 800. Centre line orientation cylinder 800 includes an upper barrel 801, which is provided with a diametrical through hole 802. The barrel 801 terminates in a lower threaded end 803. The lower threaded end 803 extends downwardly to an integral depending threaded base 804. An internally-threaded, disc-like, lock collar 805, which includes a plurality of circumferentially-arranged engagement nicks 806 therearound, is threaded onto the terminal-threaded end 803 of the barrel 801.

As noted hereinabove, the template is provided with a securement hole, e.g., in this FIG. 807, for each of the front and rear centre line orientation cylinders 800, the securement hole, e.g., 807, being along the centre line 120 as provided by the CAD program. A "T"-nut 808 is secured within each hole. It is noted that the "T"-nut 808 includes a circular, disc-like base 809 from which an internally-threaded upright cylinder 810 extends. The circular, disc-like base 809 is provided with a plurality, e.g., four, upwardly-projecting teeth (not seen). The "T"-nut 808 is secured to the template 100 by inserting the internally-threaded upright cylinder 810 into the pre-drilled hole, through holes 807 in the template 100, and then is hammered "home", so that the teeth project into the wood of the template 100, to secure the "T"-nut 808 to the template 100.

In use, the front and rear centre line orientation cylinders 800 are loosely-threaded into their associated "T"-nuts 807. When the through holes 807 are lined-up, the internally-threaded lock collar 805 is rotated so that the lock collar 805 abuts the top surface of the template 100, thereby locking the centre line orientation cylinder in that orientation. The cylindrical centre line rod 210 is then inserted through the through holes 807 to extend beyond the centre line orientation cylinders 800, as shown in FIG. 1.

Figure 9:
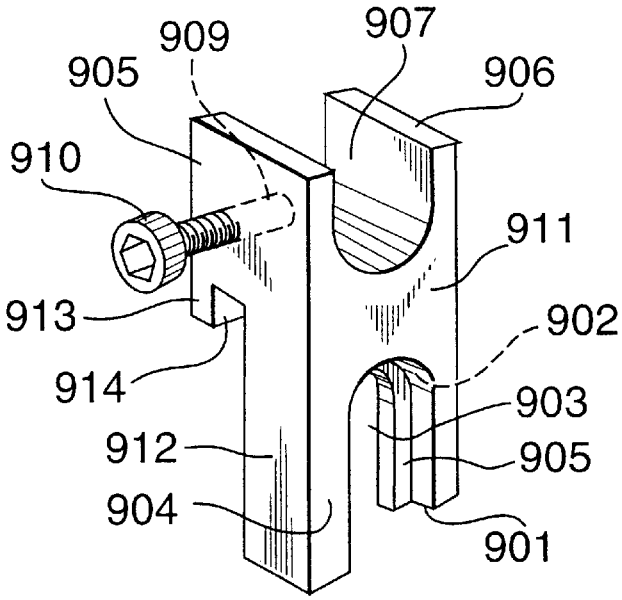
FIG. 9 is a perspective view of a centre line bracket.

FIG. 9 shows, in perspective, one embodiment of a centre line orientation bracket 900. The centre line orientation bracket 900 is generally of rectangular front and rear elevational appearance. The lower edge 901 is provided, in its interior face 902, with an upwardly-extending slot 903, and in its exterior face 904, with a similar, but larger countersunk slot 905. The upper edge 906 is provided with a semi-cylindrical cradle 907. One side edge 905 of the centre line orientation bracket 900 adjacent to its upper end is provided with an internally-threaded aperture 909, into which is threaded a suitable bolt 910, e.g., an Allen-head bolt. This suitable bolt, e.g., Allen-head bolt, may be used to lock a cylindrical centre line rod 108 in the cradle 904, if desired.

The upper portion 911 of the centre line orientation bracket 900 is thicker than the lower leg 912 thereof. The slots 903,905 are within the lower leg 912 of the centre line orientation bracket 900. The face 902 of the upper portion 911 includes a downwardly-depending flange 913 defining, between the inner edge of the downwardly-depending flange 913 and the outer edge of the lower leg 912, an attachment groove 914, which is adapted to fit into an upper flange on the front rail 201 and on the rear rail 202. This accurately locates the centre line orientation bracket on these rails.

In use, two centre line orientation brackets 900, namely the front and rear centre line orientation brackets 900, are lowered onto a respective suitable bolt 208, e.g., Allen-head bolt, which is loosely-threaded into an internally-threaded trapezoidal nut, which is slidably-retained within the dovetail-shaped internal groove 210 in the front rail 201 and in the rear rail 202, respectively, so that they are slidably-secured to the front rail 201 and to the rear rail 202, respectively. The attachment groove fits into the corresponding upper flanges on the front rail 201 and the rear rail 202, respectively. The centre line orientation brackets 900 are then slid until they are disposed at the precise centre of the front rail 201 and of the rear rail 202, respectively. Then, the suitable bolts, e.g., Allen head bolts, 211 are completely-screwed into the internally-threaded trapezoidal nuts 303, whereby the front and rear centre line orientation brackets 900 are firmly-secured at the precise centre line of the universal press frame 200.

Figure 10:
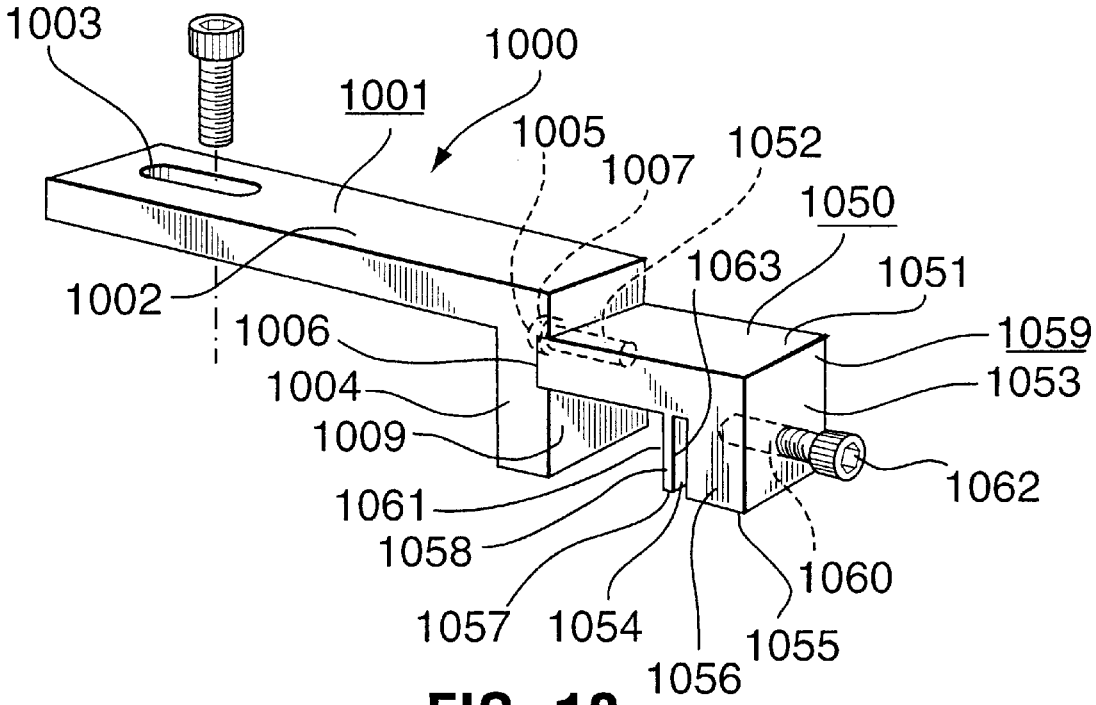
FIG. 10 is a perspective view of a template corner clamp.

FIG. 10 shows a perspective view of one embodiment of a template corner locking clamp 1000. Each template corner locking clamp 1000 includes an upper "L"-shaped component 1001 and a lower "L"-shaped component 1050. The upper "L"-shaped component 1001 includes a horizontal plate 1002 which includes a closed-ended, race-track-shaped slot 1003 therethrough near its outer end, and a vertical leg 1004. The vertical leg 1004 includes a countersunk, longitudinally-extending aperture 1005. The inner face of the vertical leg 1004 includes a longitudinally-extending channel 1006 therein.

The lower "L"-shaped component 1050 includes a horizontal arm 1051 which is provided with a longitudinally-extending, internally-threaded hole 1052 extending from its outer face, and a vertical leg 1053. The vertical leg 1053 includes a slit 1054 extending upwardly from the lower edge 1055 thereof, to provide a wide outer ledge 1056 and a narrow inner ledge 1057 defining a springingly-deforming wall 1058. The outer face 1059 is provided with an internally-tapped hole 1060 extending completely transversely through the wide outer ledge 1059 and extending into the slit 1054.

In use, the template corner locking clamp 1000 is first assembled. This is done by placing the outer face 1052 of the lower "L"-shaped component 1050 into the longitudinally-extending channel 1006 of the upper "L"-shaped plate 1001. Then, a suitable bolt, e.g., an Allen head bolt, 1007, is threaded through the countersunk hole 1005 in the upper "L"-shaped plate 1001 fully into the internally-threaded hole 1052 in the lower "L"-shaped component 1050.

Then, the assembled template corner locking clamp 1000 is dropped down to be placed atop a side rail, with the space between the inner face 1009 of the upper "L"-shaped component 1001 and the inner face 1061 of the lower "L"-shaped component 1050 providing an interference fit for the side rail. Then, a suitable bolt 1062, e.g., Allen head bolt, is threaded through the internally-threaded hole 1060 in the lower "L"-shaped component 1050 until it abuts the inner face 1063 of the slit 1054.

The template corner locking clamp 1000 is then slid along the side rail 203 to the appropriate pre-determined datum position, as defined by the CAD program. The suitable bolt 1062, e.g., the Allen head bolt, is then completely-tightened, to provide a secure frictional engagement between the template corner locking clamp 1000 and the side rail 203.

Figure 11:
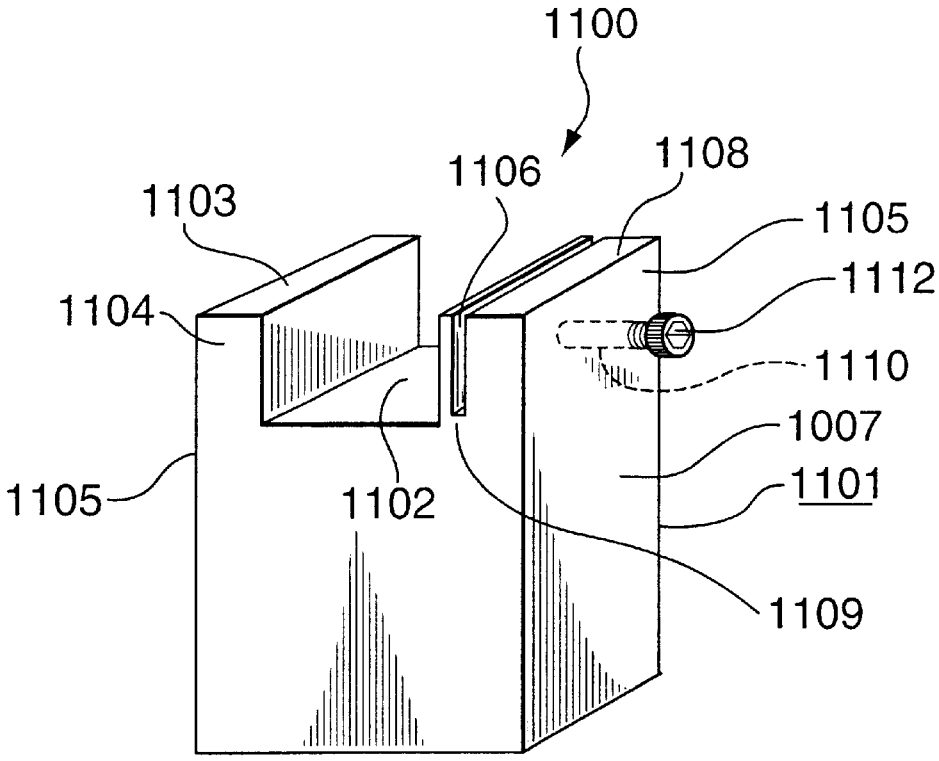
FIG. 11 is a perspective view of a leg.

FIG. 11 shows a perspective view of one embodiment of a leg 1100 which is used to support the front rail 201 and the rear rail 202 of the universal press frame 200. Each of the legs 1100 is a generally-square, rectangular parallelepiped block 1101, with a longitudinally-extending channel 1102 extending downwardly from the top face 1103 thereof. An interior ledge 1104 is provided adjacent to an interior face 1105 of the generally-square, rectangular parallelepiped block 1101. A longitudinally-extending slot 1106 is provided adjacent to the outer face 1107 of the generally-square, rectangular parallelepiped block 1101, to provide an exterior ledge 1108 and an intermediate, springingly-deformable wall 1109. The exterior face 1107 of the generally-square, rectangular parallelepiped block 1101 is provided with an internally-threaded through hole 1110, into which is threaded a suitable bolt 1112, e.g., an Allen head bolt.

In use, the front rail 201 or the rear rail 203 is inserted downwardly into the longitudinally-extending channel 1102. The relative dimensions of the channel 1102 and of the rails 201,202 are such that there is an interference fit therebetween. However, to lock the rails 201,202 to each leg 1100, the suitable bolt, e.g., the Allen head bolt, 1112, is screwed into contact with a hidden face of the intermediate springingly-deformable wall 1109. Continued screwing of the bolt 1112 springingly-deforms the springingly-deformable wall 1109 to cause a greater frictional engagement between the rails 201,202 and the associated leg 1100.

Figure 12:
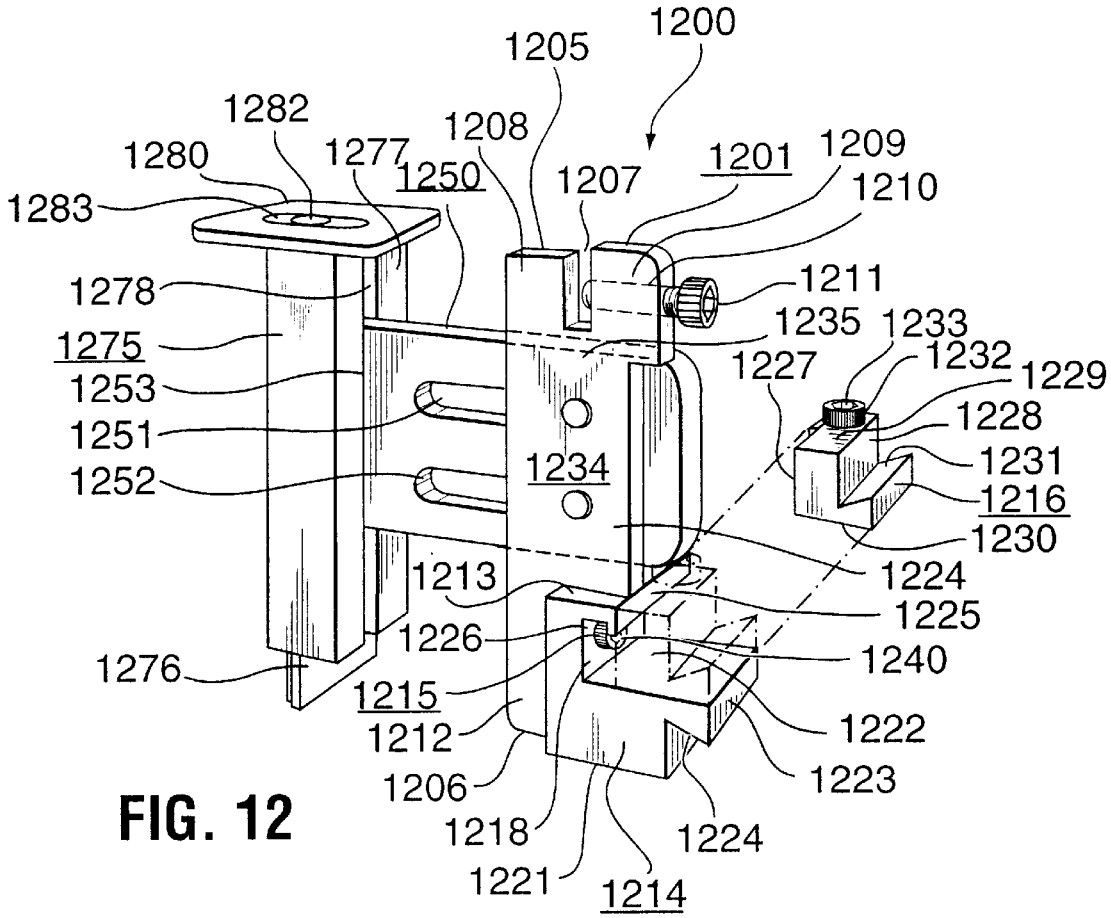
FIG. 12 is a perspective view of a jogger member, which is used for attachment to the side rails and the rear rail of the universal press frame.

FIG. 12 shows a perspective view of a preferred embodiment of a side rail jogger member and/or rear rail jogger member 1200. Such side rail jogger member and/or rear rail jogger member 1200 includes a main upright base 1201, an adjustable support member 1250 and a guiding member 1275.

Main upright base member 1201 is a generally-rectangular plate 1202, having parallel side faces, providing an interior face and an exterior face respectively, as well as an upper edge 1205 and a lower edge 1206. The upper edge 1205 is provided with downwardly-depending slot 1207, which provides an inner block-like portion 1208, and an outer, block-like portion 1209. The outer, block-like portion 1209 is provided with a transverse, internally-threaded hole 1210, extending through to the downwardly-depending slot 1207, into which is threaded a suitable bolt 1211, e.g., an Allen-head bolt.

The lower end 1212 of the main upright base member 1201 is provided with an upwardly-extending notch 1213, into which is secured a two-piece dovetail block 1214, whose structure will be described hereinafter, by means of a suitable bolt 1240, e.g., an Allen-head bolt, which is threaded into an internally-threaded aperture (not seen) in the interior face of the notch 1213.

The dovetail block 1214 is a two-piece, generally-rectangular, parallelepiped block constituted by a major piece 1215 and a minor piece 1216. The major piece 1215 is a block having an upper roof, an inner wall 1218 including an inner face, an outer face and a minor roof. Its lower edge 1221 is flush with the lower edge 1206 of the lower end 1212 of the main upright base member 1201. The front face 1223 of the two-piece dovetail block 1214 includes a major floor 1222 terminating in a projection 1224 which constitutes the lower half of the dovetail. The upper edge of the lower half of the dovetail is flush with the intermediate floor 1222. The minor roof is provided with a downwardly-depending flange 1225, so that a slot 1226 is provided between the outer face of the inner wall 1218 and the inner face of the downwardly-depending flange 1225. This slot 1226 accommodates the suitable bolt 1240, e.g., an Allen-head bolt, which secures the major piece 1215 of the two-piece dovetail block 1214 to the main upright base member 1201.

The two-piece dovetail block 1214 further includes a minor piece 1226 in the form of a block including an inner face 1227, an outer face 1228, an upper roof 1229, and a lower floor 1230. The outer face 1228 includes an upwardly-extending projection 1231 which constitutes the upper half of a dovetail and terminates in a front face 1231. The lower face of the upwardly-extending projection 1231 is flush with the major floor 1222. The upper roof 1229 is provided with a downwardly-extending, internally-threaded hole 1232 which extends through the lower floor 1230. A suitable bolt 1233, e.g., an Allen-head bolt, is threaded into the downwardly-extending, internally-threaded hole 1232.

The central portion 1234 of the main upright base member 1201 is provided with a transversely-extending channel 1235, which is inset into one side face thereof. That side face is provided with a pair of longitudinally-spaced-apart, internally-threaded apertures (not seen). This pair of longitudinally-spaced-apart, internally-threaded apertures (not seen) apertures are fitted with suitable bolts (not seen), e.g., Allen-head bolts. The adjustable support member 1250 is adapted to be slidably-fitted within that transversely-extending channel 1235.

The adjustable support member 1250 includes a pair of vertically-spaced-apart, longitudinally-extending slots 1251, 1252, the spacing of the pair of vertically-spaced-apart, longitudinally-extending slots 1251,1252 being the same as the spacing of the pair of longitudinally-spaced-apart, internally-threaded apertures (not seen) in the main upright base member 1201. The adjustable support member 1250 is slidably-retained with respect to the main upright base member 1201 by the threading of the suitable bolts (not seen), e.g., Allen head bolts, which pass through the respective pair of vertically-spaced-apart, longitudinally-extending slots 1251,1252 and into the respective pair of longitudinally-spaced-apart, internally-threaded apertures (not seen) in the central portion 1234. The end interior face 1253 of the adjustable support member 1250 is provided with a tapped aperture (not seen) by means of which the adjustable support member 1250 may be attached to the guiding member 1275 by suitable bolts (not seen), e.g., Allen-head bolts.

The guiding member 1275 is a generally-rectangular, parallelepiped member, whose interior face 1277 is provided with vertically-extending channel 1278 therein. The interior face 1253 of the adjustable support member 1250 is fitted into the vertically-extending channel 1278, and is then secured therein by means of the suitable bolt (not seen), e.g., an Allen-head bolt, which is threaded into the tapped aperture in the interior face 1253 of the adjustable support member 1250. The exterior edge of the guiding member 1275 provides a guiding edge. Within that guiding edge is a captive slidable guiding member 1276. The slidable guiding member 1276 includes a main vertical bar including a central groove which is provided with lateral underscored groove. The guiding edges includes flanges which are complementary with underscored grooves so that the captive slidable guiding member 1276 is slidably-held to guiding edge by means of the same bolt (not seen) which is threaded into a tapped aperture (not seen) in the interior face 1253 of the adjustable support member 1250.

A cap 1280 is selectively-adjustably held to the top face 1281 of the guiding member 1275 by means of a screw 1282 into a tapped aperture (not seen) in its top face 1281, the screw being within slot 1283 in cap 1280.

In use, the jogger member 1200 is placed in the rail by inserting the major piece 1215 of the two-piece dovetail block 1214 into the dovetail slot 210 in the rail 202,203, or 204, by being tilted at a suitable angle to enable such insertion. Then, the minor piece 1226 of the two-piece dovetail block 1214 is inserted into the dovetail slot 210, and is slid until it aligns with the major piece 1215 to form a complete dovetail, as a two-piece dovetail block 1214. The suitable bolt 1229, e.g., the Allen-head bolt, is then loosely-threaded to hold the two-piece dovetail block 1214 as an integral unit. The jogger member 1200 is then placed in its required position in the respective rail 201,202,203, or 204 according to the shape of the template 100. Then, the suitable bolt 1223, e.g., the Allen head bolt, is completely-threaded, to expand the two-piece dovetail block 1214 into the dovetail groove 210 and thereby to fix the jogger member 1200 in its accurately-placed position.

The adjustable support member 1250 is then advanced inwardly so that the guiding member 1275 abuts the pre-selected edge of the template 100. The adjustable support member 1250 is fixed in that position by tightening the two spaced-apart bolts (not seen) into the spaced-apart, internally-threaded apertures (not seen) in the main upright base member 1201.

The cap 1280 is then adjusted so that it extends a small distance over the edges of the guiding member 1275, so as to provide a temporary support for the perimetral edges of a blanked sheet.

Figure 13:
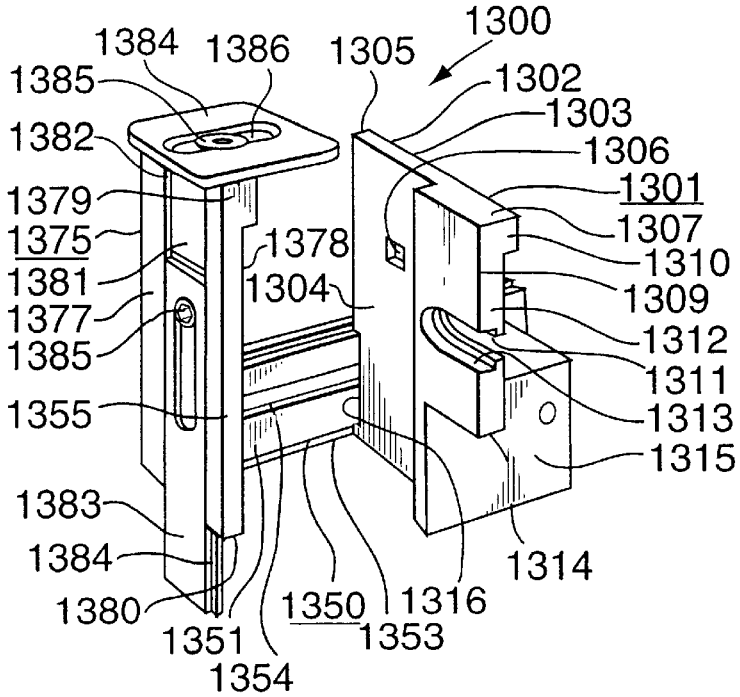
FIG. 13 is a perspective view of a jogger member, which is used for attachment to the front rail of the universal press frame.

FIG. 13, shows a perspective view of another variant of a jogger member 1300 which is particularly-adapted to be used as a front jogger member to be secured to the front rail 201. It includes a main upright base member 1301, an adjustable support member 1350 and a guiding member 1375.

Main upright base member 1301 is a primary, generally-rectangular plate 1302, having outer generally-rectangular faces 1303 and inner generally-rectangular faces 1304 and a free side edge 1305. These outer generally-rectangular faces 1303, and inner generally-rectangular faces 1304 are pierced by a square hole 1306. The opposed side edge is integral with a secondary generally-rectangular plate 1307, having outer generally-rectangular faces 1303, and inner generally-rectangular faces 1309, with outer generally-rectangular faces 1303 and inner generally-rectangular faces 1304 generally being flush with the one another. The outer generally-rectangular face 1303, is provided with an integral downwardly-projecting flange 1310. The outer generally-rectangular face 1303, is provided with an open-ended slot 1311 extending inwardly from a free side edge 1312 of the secondary, generally-rectangular plate 1307 and the inner generally-rectangular face 1304 is provided with a similar countersunk, slightly-larger slot 1313. The lower end 1314 of the secondary generally-rectangular plate 1307 is cut-away to reveal a lower cubic block 1315, which is also integral with the outer generally-rectangular face 1303, of the main upright base member 1301. The secondary generally-rectangular plate 1307 is approximately twice as thick as the primary generally-rectangular plate 1302. Finally, the free side edge 1305 and the front face (not seen) of the lower cubic block 1315 are provided with a connected transversely-extending channel 1316. That front edge 1305, as well as the front face of the lower cubic block 1315, are provided with tapped apertures (not seen) by means of which the adjustable support member 1350 may be slidably-attached.

The adjustable support member 1350 comprises a horizontal leg 1351 which is of the same height as the transversely-extending channel 1316. The horizontal leg 1351 includes upper longitudinal cut-outs 1352 and lower longitudinal cut-outs 1353 which cooperate with the complementary transversely-extending channel 1316 in the front edge of the primary generally-rectangular plate 1302 and in the lower cubic block 1315. It also includes a longitudinally-extending slot 1354 by means of which it may be slidably-adjustably held to main upright member 1301 by means of suitable bolts (not seen), e.g., Allen-head bolts, which are disposed within tapped apertures (not seen) in the primary plate 1302. As well, the butting edge 1355 of the adjustable support member 1350 is provided with a tapped aperture (not seen).

The guiding member 1375 is a generally-rectangular, vertically-upright plate 1376, whose width is substantially-equal to the width of the primary generally-rectangular plate 1302. The generally-rectangular, vertically-upright plate 1376 includes an outer face 1377 and an inner face 1378, as well as an upper roof 1379 and a lower edge 1380. The inner face 1378 includes a square protrusion (not seen) for accurate-fitting into the square hole 1306 in the primary generally-rectangular plate 1302 of the main upright member 1301.

The outer face 1377 includes a central groove 1381 which is provided with lateral underscored grooves 1382. A guiding plate 1383 includes flanges 1384 which are complementary with the underscored grooves 1382. The guiding plate 1383 is slidably-held to the outer face 1377 by means of suitable bolt 1385, e.g., an Allen-head bolt, which is screwed into an aperture (not seen) in the central groove 1381. It is seen that guiding plate 1383 can more freely-downwardly by gravity. In addition, the central groove 1381 is provided with a further aperture (not seen), into which a suitable bolt (not seen), e.g., an Allen-head bolt, is threaded into the internally-threaded aperture (not seen) in the side edge 1355 of the adjustable support member 1350, in order to hold the adjustable support member 1350 securely to the guiding member 1375.

A cap 1384 is selectively-adjustably held to the top roof 1379 of the generally-rectangular, vertically-upright plate 1376 by means of a screw 1385 which is threaded into a tapped aperture (not seen) in the top roof 1379, the screw 1385 being within a slot 1386 in the cap 1384.

In use, the jogger member 1300 is placed on the front rail 201 by being slid longitudinally by means of slots 1311,1313 onto suitable, inwardly-projecting bolts (not seen), e.g., Allen-head bolts, which have been loosely-threaded into the internally-threaded trapezoidal nuts (not seen) within the dovetail-shaped groove 210 of the front rail 201.

The jogger member 1300 is then placed in its required position in the front rail 201 according to the shape of the template 100. Then, the suitable bolt (not seen), e.g., the Allen-head bolt, is completely-threaded, to fix the jogger member 1300 in its accurately-placed position.

The adjustable support member 1350 is then advanced inwardly to abut the pre-selected edge of the template 100, as required to break the nicks in the blanked carton. The guiding member 1375 is fixed in that position by tightening the bolts into the internally-threaded apertures (not seen) in the main upright base member 1301.

The cap 1384 is then adjusted so that it extends a small distance over the edges of the guiding member 1375, so as to provide a temporary support for the perimetral edges of a blanked sheet.

Figure 14:
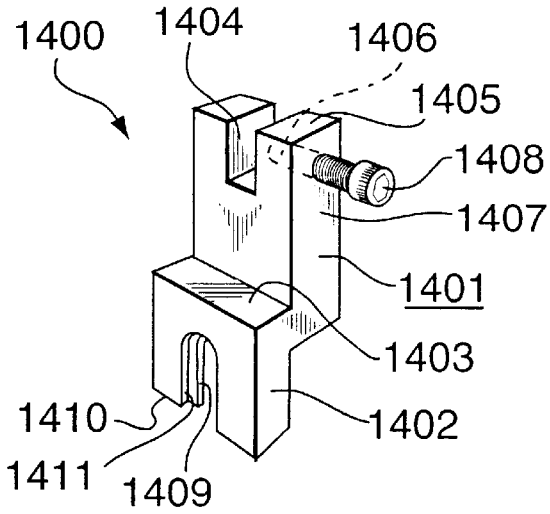
FIG. 14 is a perspective view of a grid orientation bracket.

FIG. 14 shows a perspective view of one embodiment of a grip support bracket 1400. This grid support bracket 1400 is generally step-shaped and includes an upper vertical arm 1401 and a lower vertical leg 1402, which are joined by a horizontal deck 1403. The upper vertical arm 1401 includes a downwardly-extending slot 1404, extending downwardly from its upper edge 1405. A tapped, transverse, through-aperture 1406 is formed in one side face 1407 of the upper vertical arm 1401, into which is inserted a suitable lock bolt 1408, e.g., an Allen head bolt. When used in conjunction with the grid 404, (as seen in FIG. 4) the suitable lock bolt 1408, e.g., an Allen-head bolt, is turned until it contacts and locks the grid 404 into the slot 1404.

The lower leg 1402 is of a dimension to enable it to cooperate with the associated rails 201,202,203,204 of the universal press frame 200. The lower leg 1402 also includes a closed-ended slot 1409 extending upwardly from the lower free edge 1410 thereof, the slot 1409 including countersunk portion 1411.

In use, the grid support brackets 1400 are loosely placed on the rails by being dropped vertically onto projecting suitable bolts (not seen), e.g., Allen head bolts, which have been loosely-threaded into internally-threaded trapezoidal nuts (not seen) within the dovetail-shaped groove 210 of the rails 201,202,203,204.

The grid rails 405 of the grid 404 are placed within the upper vertical slot 1404, and are held in that position by completely-threading the lock bolts 1408, e.g., Allen head bolts. The grid support bracket 1400, which is accurately located in the correct position by the grid 404, is fixed in position by completely-threading the lock bolt 1308, e g., an Allen head bolt, into the internally-threaded trapezoidal nut (not seen).

Figure 15:
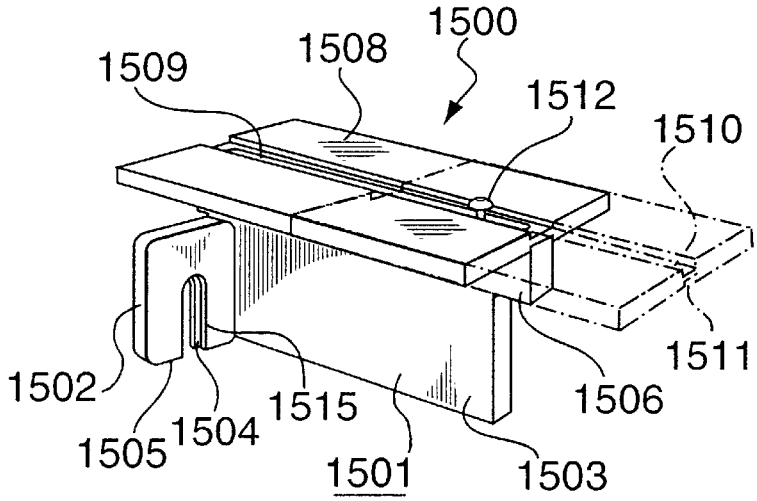
FIG. 15 is a perspective view of an auxiliary support member.
Figure 16:
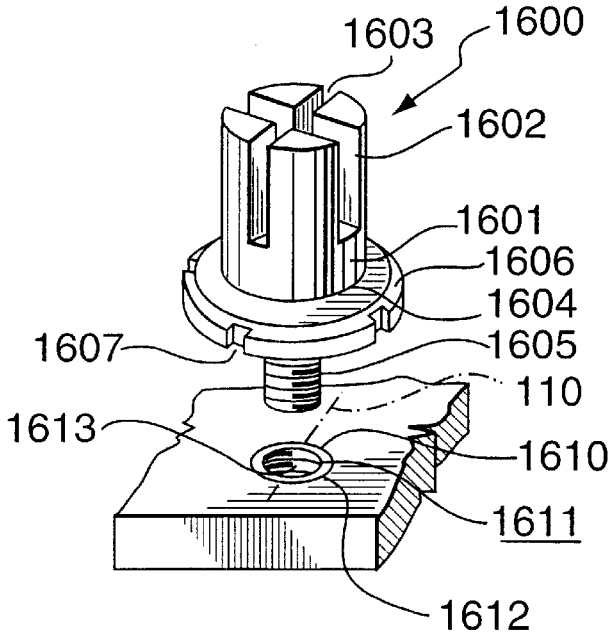
FIG. 16 is a perspective view of a grid orientation cylinder about to be inserted in a "T"-nut which is secured within an aperture in the template.

FIG. 15 show a perspective view of one embodiment of an auxiliary adjustable support member 1500. This auxiliary adjustable support member 1500 includes a support base 1501 comprising a transverse plate 1502 and an integral longitudinal plate 1503. The transverse plate 1502 is of a dimension enabling it to cooperate with the rails 201,202, 203,204 of the universal press frame 200, by means of the two (only one of which is seen) spaced-apart slots 1504 extending upwardly from the lower edge 1505 thereof, slots 1504 including a countersunk portion 1515. These two (only one of which being seen) spaced-apart slots 1504 are adapted to cooperate with suitable bolts (not seen) which are slidably-disposed within the dovetail-shaped groove 210 in the rails 202,203,204.

The integral longitudinal plate 1503 includes an integral upper cantilevered block 1506, the upper face 1507 thereof being provided with a tapped aperture.

The auxiliary adjustable support member 1500 further includes a captive, longitudinally-slidable table 1508 having a double-closed-ended longitudinally-extending slot 1509 therein, and upper grooves 1510 and lower grooves 1511 which are complementary to the slot 1509. The longitudinally-slidable table 1508 is held captive on the upper cantilevered block 1508 by means a screw 1512 which is screwed into the tapped aperture (not seen). The longitudinally-slidable table 1508 can, thus, be adjusted longitudinally as shown in dot-and-peck lines.

In use, the auxiliary adjustable support member 1500 is loosely placed onto the rails 202,203,204 by being dropped vertically onto the inwardly-projecting suitable bolts (not seen), e.g., Allen head bolts, which have been loosely-threaded into the internally-threaded trapezoidal nuts (not seen) which have been placed within the dovetail-shaped groove.

The auxiliary adjustable support member 1500 is then placed in its required position on the rail 202,203,204 according to the shape of the template 100. Then, the suitable bolt (not seen), e.g., the Allen head bolt, is completely-threaded, to fix the auxiliary adjustable support member 1500 in its accurately-placed position.

The longitudinally-slidable table 1508 on the auxiliary adjustable support member 1500 is then advanced inwardly to extend a pre-selected distance over an edge of the template 100, by sliding of its slot 1504 with respect to the screw 1512. When the longitudinally-slidable table 1508 is so-adjusted, i.e., so that it extends a small distance over the edges of the template 100 so as to provide an additional temporary support for perimetral edges of the blanked sheet, the screw 1512 is tightened.

The auxiliary adjustable support member 1500 is then fixed in that position by tightening the two spaced-apart bolts (not seen) into the spaced-apart, internally-threaded trapezoidal nuts (not seen), which are within the dovetail groove 209.

FIG. 15 is a perspective view of one embodiment of a grid orientation cylinder 1600. The grid orientation cylinder 1600 includes an upper barrel 1601, which is provided with a pair of mutually-transverse, upper slots 1602,1603 whose widths are different, to accommodate grids 404 formed of two different thicknesses of grid rails 405. The barrel 1601 terminates in an integral threaded end 1604, and is integral with a depending lower threaded base 1605. An internally-threaded circular disc-like collar 1606 which includes a plurality of circumferentially-arranged engagement nicks 1607 is threaded onto the terminal integral threaded end 1604.

The template 100 is provided with a through hole, e.g., 1610, along the outline 110 of the blanked cartons, according to the instructions which are provided by the CAD program as previously-described.

A "T"-nut 1611 is secured within each through hole, e.g., 1610. It is noted that the "T"-nut 1611 includes a circular, disc-like base 1612 from which an internally-threaded upright cylinder 1613 extends. The circular, disc-like base 1613 is provided with a plurality, e.g., four upwardly-projecting teeth (not seen). The "T"-nut 1611 is secured to the template 100 by inserting the internally-threaded upright cylinder into the pre-drilled hole 1610, and then is hammered "home", so that the teeth project into the wood of the template 100, thereby firmly securing the "T"-nut 1611 to the template 100.

In use, the grid cylinders 1600 are loosely-threaded into their associated "T"-nuts 1611, and rotated until the selected upper slot of the pair of mutually-transverse, upper slots 1602 or 1603, is orientated to accommodate the grid rails 405 of the grid 404.

When the pair of mutually-transverse, upper slots 1602, 1603 are correctly-oriented, the circular, disc-like collar 1606 is rotated until the collar 1606 abuts the top surface of the template 100. The grid orientation cylinders 1600 are thus secured at that correctly-oriented position by means of the frictional engagement of the interiorly-threaded lock collars 1606 with the upper surface of the template 100.

What is claimed is:

1. A universal press frame for use in the setting-up of a female blanking die for a die cutting machine for die cutting and/or blanking a carton blank, said universal press frame comprising:

a rectangular framework comprising two opposed side rails, a front rail, a rear rail and two side rails, said rails each being provided with a dovetail groove along its inside edge, said rectangular frame having a longitudinally-extending centre line which is marked on said front rail and on said rear rail, and particularly-specified datum lines which are marked on said side rails;

four template corner locking clamps, each template corner locking clamp including means to secure it to a side rail of said universal press frame and a slotted inwardly-directed arm, each said template corner locking clamp being secured to an associated side rail at said particularly-specified datum lines adjacent to said front rail and to said rear rail, with said slotted arm projecting into the interior area of said universal press frame; and a template, the shape of said template being of the outer shape of a sheet containing a plurality of cartons which have been cut by the die cutting machine, and also including thereon a centre line and other datum points for accurately-aligning said template within said universal press frame to provide a female blanking die, said template including centre line datum apertures along the centre line adjacent to the front end and to the rear end of said template and other datum apertures at the other datum points, said apertures including retention means within said apertures, and means, cooperating between said template and said template corner locking clamps, whereby said template is locked atop said template corner locking clamps, said template being locked atop said four template corner locking clamps at the precise location within said rectangular framework which has been predetermined so that said female blanking die and a male blanking die may be accurately aligned in said die cutting machine.

2. A universal press frame for use in the setting-up of a female blanking die for a die cutting machine for die cutting and/or blanking a carton blank, said universal press frame comprising:

a rectangular framework comprising two opposed side rails, a front rail, a rear rail and two side rails, said rails each being provided with a dovetail groove along its inside edge, said rectangular frame having a longitudinally-extending centre line which is marked on said front rail and on said rear rail, and particularly-specified datum lines which are marked on said side rails;

four template corner locking clamps, each template corner locking clamp including means to secure it to a side rail of said universal press frame and a slotted inwardly-directed arm, each said template corner locking clamp being secured to an associated side rail at said particularly-specified datum lines adjacent to said front rail and to said rear rail, with said slotted arm projecting into the interior area of said universal press frame;

a template, the shape of said template being of the outer shape of a sheet containing a plurality of cartons which have been cut by said die cutting machine, and also including thereon a centre line and other datum points for accurately-aligning said template within said universal press frame to provide a female blanking die, said template including two longitudinally-spaced-apart apertures along said centre line adjacent to the front end and to the rear end of said template and other datum apertures at the other datum points, said apertures including retention means within said apertures, the underside of said template including a plurality of removably-secured foam plastic blocks, which are disposed in accurately-predetermined locations thereon, and means, cooperating between said template and said template corner locking clamps, whereby said template is locked atop said template corner locking clamps, said template being locked atop said four template corner locking clamps at the precise location within said rectangular framework which has been predetermined so that said female blanking die and a male blanking die may be accurately aligned in said die cutting machine; and a plurality of jogger members, each jogger member comprising a base member and means for insertion in said dovetail groove of said rails, an adjustable support member which is adjustably-slidably-disposed with respect to said base member, and a guiding member having an upper edge and a lower edge, said guiding member being secured to one face of said adjustable support member to provide a depending guiding face, said plurality of jogger members being oriented along the interior perimeter of said rectangular framework in such a way that said depending guiding faces abut selected edges of the perimeter of said template, said abutted guiding faces of said depending guiding faces, together with said template, thereby constituting a perimeter that is substantially-identical to the outer perimetrical shape of a sheet containing a plurality of carton blanks which have been die-cut from a sheet by a male cutting die of said die cutting machine.

3. A universal press frame for use in the setting-up of a female blanking die for a die cutting machine for die cutting and/or blanking a carton blank, said universal press frame comprising:

a rectangular framework comprising two opposed side rails, a front rail, a rear rail and two side rails, said rails each being provided with a dovetail groove along its inside edge, said rectangular frame having a longitudinally-extending centre line which is marked on said front rail and on said rear rail, and particularly-specified datum lines which are marked on said side rails;

four template corner locking clamps, each template corner locking clamp including means to secure it to a side rail of said universal press frame and a slotted inwardly-directed arm, each said template corner locking clamp being secured to an associated side rail at said particularly-specified datum lines adjacent to said front rail and to said rear rail, with said slotted arm projecting into the interior area of said universal press frame;

a template, the shape of said template being of the outer shape of a sheet containing a plurality of cartons which have been cut by the die cutting machine, and also including thereon a centre line and other datum points for accurately-aligning said template within said universal press frame to provide a female blanking die, said template including two longitudinally-spaced-apart apertures along said centre line adjacent to the front end and to the rear end of said template and other datum apertures at said other datum points, said apertures including retention means within said apertures, the underside of said template including a plurality of removably-secured foam plastic blocks, which are disposed in accurately-predetermined locations thereon, and means, cooperating between said template and said template corner locking clamps, whereby said template is locked atop said template corner locking clamps, said template being locked at the precise location within said rectangular framework which has been predetermined so that said female blanking die and a male blanking die may be accurately aligned in said die cutting machine; and a plurality of jogger members, each jogger member comprising a base member and means for insertion in said dovetail groove of said rails, an adjustable support member which is adjustably-slidably-disposed with respect to said base member, and a guiding member having an upper edge and a lower edge, said guiding member being secured to one face of said adjustable support member to provide a depending guiding face, said jogger member also including slidable captive cap means having a leading edge, said slidable captive cap means being slidably-secured to said depending guiding member, said jogger members being disposed in spaced-apart orientation along the interior periphery of said universal press frame on said side rails, on said front rail and on said rear rail, said plurality of jogger members being adjusted until said depending guiding faces of said jogger members abut selected edges of the periphery of said template, and the leading edge of said slidable captive cap means being disposed a predetermined cantilevered distance over said depending guiding face of said depending guiding member, said plurality of jogger members being oriented along the interior perimeter of said rectangular framework in such a way that said depending guiding faces abut selected edges of the perimeter of said template, said abutted guiding faces of said depending guiding members, together with said template, thereby constituting a perimeter that is substantially-identical to the outer perimetrical shape of a sheet containing a plurality of carton blanks which have been die-cut from a sheet by a male cutting die of said die cutting machine, and said leading edges of said slidable captive cap means which are atop said depending guiding members thereby extending as far as an "imaginary" perimeter which would be defined by joining the leading edges of said slidable captive cap means which constitutes a perimeter that is substantially-similar to, but is slightly larger than, the perimetrical shape of a sheet containing the carton blanks which have been die-cut by the male cutting die of the die cutting machine, so that said slidable captive cap means provide a temporary support for selected areas of a sheet containing the carton blanks which have been die-cut from a sheet by a male cutting die of said die cutting machine.

4. A universal press frame for use in the setting-up of a female blanking die for a die cutting machine for die cutting and/or blanking a carton blank, said universal press frame comprising:

a rectangular framework comprising two opposed side rails, a front rail, a rear rail and two side rails, said rails each being provided with a dovetail groove along its inside edge; said rectangular frame having a longitudinally-extending centre line which is marked on said front rail and on said rear rail, and particularly-specified datum lines which are marked on said side rails;

four template corner locking clamps, each template corner locking clamp including means to secure it to a side rail of said universal press frame and a slotted inwardly-directed arm, each said template corner locking clamp being secured to an associated side rail at said particularly-specified datum lines adjacent to said front rail and to said rear rail, with said slotted arm projecting into the interior area of said universal press frame;

a template, the shape of said template being of the outer shape of a sheet containing a plurality of cartons which have been cut by the die cutting machine, and also including thereon a centre line and other datum points for accurately-aligning said template within said universal press frame to provide a female blanking die, said template including two longitudinally-spaced-apart apertures along said centre line adjacent to the front end and to the rear end of said template and other datum apertures at said other datum points, said apertures including retention means within said apertures, the underside of said template including a plurality of removably-secured foam plastic blocks, which are disposed in accurately-predetermined locations thereon, and means, cooperating between said template and said template corner locking clamps, whereby said template is locked atop said template corner locking clamps, said template being locked at the precise location within said rectangular framework which has been predetermined so that said female blanking die and a male blanking die may be accurately aligned in said die cutting machine;

a plurality of grid orientation cylinders, each said grid orientation cylinder including an upper barrel, at least one orientatable slot in said upper barrel end, and having means for removably-disposing said grid orientation cylinders in preselected datum apertures in said template, said grid orientation cylinders being disposed in said preselected datum apertures in said template;

a plurality of grid support members, each grid support member including means to secure it to a rail of said universal press frame, and a longitudinally-extending slot in its upper end, said grid support members being disposed in spaced-apart orientation along the interior periphery of said universal press frame on said side rails, on said front rail and on said rear rail, respectively;

a grid comprising a plurality of intersecting longitudinal and transverse grid rails, said intersecting grid rails coinciding with abutting portions of the plurality of cartons which have been die-cut from a sheet by a male cutting die of said die cutting machine, said grid rails being disposed in selected slots in said grid orientation cylinders atop said template and in said slots in said grid support members, in order accurately to position said grid in said universal press frame, longitudinal and transverse projecting portions of said grid rails which are disposed in said slots in said grid support members being secured in fixed position in said slots, and said grid support members being then secured in locked positions on the interior perimeter of said universal press frame, thereby accurately to fix the grid to said universal press frame; and a plurality of jogger members, each jogger member comprising a base member and means for insertion in said dovetail groove of said rails, an adjustable support member which is adjustably-slidably-disposed with respect to said base member, and a guiding member having an upper edge and a lower edge, said guiding member being secured to one face of said adjustable support member to provide a depending guiding face, said jogger members being disposed in spaced-apart orientation along the interior periphery of said universal press frame on said side rails, on said front rail and on said rear rail, said plurality of jogger members being adjusted until said depending guiding faces of said jogger members abut selected edges of the periphery of said template, said plurality of jogger members being oriented along the interior perimeter of said rectangular framework in such a way that said depending guiding faces abut selected edges of the perimeter of said template, said abutted guiding faces of said depending guiding members, together with said template, thereby constituting a perimeter that is substantially-identical to the outer perimetrical shape of a sheet containing a plurality of carton blanks which have been die-cut from a sheet by a male cutting die of said die cutting machine.

5. A female blanking die for a die cutting machine for die cutting and/or blanking a carton blank, said universal press frame comprising:

a rectangular framework comprising a front rail, a rear rail and two side rails, said rails each being provided with a dovetail groove along its inside edge, said rectangular frame having a longitudinally-extending centre line which is marked on said front rail and on said rear rail, and particularly-specified datum lines which are marked on said side rails;

four template corner locking clamps, each said template corner locking clamp including means to secure it to a side rail of said universal press frame and a slotted inwardly-directing arm, each corner locking clamp being secured to an associated side rail adjacent to said front rail and adjacent to said rear rail at said particularly-specified datum lines, with said slotted inwardly-directing arm projecting into the interior area of said universal press frame;

a template, the shape of said template being of the outer shape of a sheet containing a plurality of cartons which have been die-cut by said die cutting machine, and also including thereon a centre line and other datum points for accurately-aligning said template within said universal press frame to provide a female blanking die, said template including two longitudinally-spaced-apart apertures along said centre line adjacent to said front end and adjacent to said rear end of said template and other datum apertures at said other datum points, said apertures including retention means within said apertures, the underside of said template including a plurality of removably-secured foam plastic blocks, which are disposed in accurately-predetermined locations thereon, and means, cooperating between said template and said template corner locking clamps, whereby said template is locked atop said template corner locking clamps, said template being locked atop said four template corner locking clamps at the precise location within said rectangular framework which has been predetermined so that said female blanking die and a male blanking die may be accurately aligned in said die cutting machine;

a plurality of grid orientation cylinders, each said grid orientation cylinder including an upper barrel, at least one orientatable slot in said upper barrel end, and having means for removably-disposing said grid orientation cylinders in preselected datum apertures in said template, said grid orientation cylinders being inserted at predetermined accurate positions atop said template;

a plurality of grid support brackets, each grid support bracket including means to secure it to a rail of said universal press frame, and a longitudinally-extending slot in its upper end, said grid support brackets being selectively-disposed along two opposed side rails, along the front rail and along the rear rail of the rectangular framework on the interior perimeter of said rectangular framework;

a grid comprising a plurality of intersecting longitudinal and transverse grid rails, said intersecting grid rails coinciding with abutting portions of the plurality of cartons which have been die-cut from a sheet by a male cutting die of said die cutting machine, said grid rails being disposed in selected slots in said grid orientation cylinders atop said template and in said slots in said grid support brackets, said grid support brackets then being secured in locked positions on the interior perimeter of said universal press frame, when said grid rails are disposed in said slots in said grid support bracket; and a plurality of jogger members, which are selectively-disposed along the interior perimeter of the rectangular framework, each jogger member comprising a base member and means for insertion in said dovetail groove of said rails, an adjustable support member which is adjustably-slidably-disposed with respect to said base member, and a guiding member having an upper edge and a lower edge, said guiding member being secured to one face of said adjustable support member to provide a depending guiding face, said jogger member also including slidable captive cap means having a leading edge, said slidable captive cap means being slidably-secured to said depending guiding member, disposing said jogger members in spaced-apart orientation along the interior periphery of said universal press frame on said side rails, on said front rail and on said rear rail, said plurality of jogger members being adjusted until said depending guiding faces of said jogger members abut selected edges of the periphery of said template, and said leading edge of said slidable captive cap means being disposed at a predetermined cantilevered distance over said depending guiding face of said depending guiding member, said plurality of jogger members being oriented along the interior perimeter of said rectangular framework in such a way that said depending guiding faces abut selected edges of the perimeter of said template, said abutted guiding faces of said depending guiding members, together with said template, thereby constituting a perimeter that is substantially-identical to the outer perimetrical shape of a sheet containing a plurality of carton blanks which have been die-cut from a sheet by a male cutting die of said die cutting machine, and said leading edges of said slidable captive cap means which are atop said depending guiding members thereby extending as far as an "imaginary" perimeter which would be defined by joining the leading edges of said slidable captive cap means which constitutes a perimeter that is substantially-similar to, but is slightly larger than, the perimetrical shape of a sheet containing the carton blanks which have been die-cut by the male cutting die of the die cutting machine, so that said slidable captive cap means provide a temporary support for selected areas of the sheet containing the carton blanks which have been die-cut from a sheet by a male cutting die of said die cutting machine.

6. A female blanking die for a die cutting machine for die cutting and/or blanking a carton blank, said universal press frame comprising:

a rectangular framework comprising a front rail, a rear rail and two side rails, said rails each being provided with a dovetail groove along its inside edge, said rectangular frame having a longitudinally-extending centre line which is marked on said front rail and on said rear rail, and particularly-specified datum lines which are marked on said side rails;

four template corner locking clamps, each said template corner locking clamp including means to secure it to a side rail of said universal press frame and a slotted inwardly-directing arm, each corner locking clamp being secured to an associated side rail adjacent to said front rail and to said rear rail at preselected positions, with said slotted inwardly-directing arm projecting into the interior area of said universal press frame;

a template, the shape of said template being of the outer shape of a sheet containing a plurality of cartons which have been die-cut by said die cutting machine, and also including thereon a centre line and other datum points for accurately-aligning said template within said universal press frame to provide a female blanking die, said template including two longitudinally-spaced-apart apertures along said centre line adjacent to said front end and to said rear end of said template and other datum apertures at said other datum points, said apertures including retention means within said apertures, the underside of said template including a plurality of removably-secured foam plastic blocks, which are disposed in accurately-predetermined locations thereon, and means, cooperating between said template and said template corner locking clamps, whereby said template is locked atop said template corner locking clamps, said template being locked atop said four template corner locking clamps at the precise location within said rectangular framework which has been predetermined so that said female blanking die and a male blanking die may be accurately aligned in said die cutting machine;

a plurality of grid orientation cylinders, each said grid orientation cylinder including an upper barrel, at least one orientatable slot in said upper barrel end, and having means for removably-disposing said grid orientation cylinders in preselected datum apertures in said template, said grid orientation cylinders being secured at predetermined accurate positions atop said template;

a plurality of grid support brackets, each grid support bracket including means to secure it to a rail of said universal press frame, and a longitudinally-extending slot in its upper end, said grid support brackets being selectively-disposed along two opposed side rails, along the front rail and along the rear rail of the rectangular framework on the interior perimeter of said rectangular framework;

a grid comprising a plurality of intersecting longitudinal and transverse grid rails, said intersecting grid rails coinciding with abutting portions of the plurality of cartons which have been die-cut from a sheet by a male cutting die of said die cutting machine, said grid rails being disposed in selected slots in said grid orientation cylinders atop said template and in said slots in said grid support brackets, said grid support brackets then being secured in locked positions on the interior perimeter of said universal press frame by securing longitudinal and transverse projecting portions of said grid rails which are disposed in said slots in said grid support brackets in fixed position in said slots;

a plurality of jogger members, each jogger member comprising a base member and means for insertion in said dovetail groove of said rails, an adjustable support member which is adjustably-slidably-disposed with respect to said base member, and a guiding member having an upper edge and a lower edge, said guiding member being secured to one face of said adjustable support member to provide a depending guiding face, said jogger member also including slidable captive cap means having a leading edge, said slidable captive cap means being slidably-secured to said depending guiding member, said jogger members being disposed in spaced-apart orientation along the interior periphery of said universal press frame on said side rails, on said front rail and on said rear rail, said plurality of jogger members being adjusted until said depending guiding faces of said jogger members abut selected edges of the periphery of said template, and said leading edge of said slidable captive cap means being disposed at a predetermined cantilevered distance over said depending guiding face of said depending guiding member, said plurality of jogger members being oriented along the interior perimeter of said rectangular framework in such a way that said depending guiding faces abut selected edges of the perimeter of said template, said abutted guiding faces of said depending guiding members, together with said template, thereby constituting a perimeter that is substantially-identical to the outer perimetrical shape of a sheet containing a plurality of carton blanks which have been die-cut from a sheet by a male cutting die of said die cutting machine, and said leading edges of said slidable captive cap means which are atop said depending guiding members thereby extending as far as an "imaginary" perimeter which would be defined by joining the leading edges of said slidable captive cap means which constitutes a perimeter that is substantially-similar to, but is slightly larger than, the perimetrical shape of a sheet containing the carton blanks which have been die-cut by the male cutting die of the die cutting machine, so that said slidable captive cap means provide a temporary support for selected areas of the sheet containing the carton blanks which have been die-cut from a sheet by a male cutting die of said die cutting machine; and a plurality of auxiliary adjustable support members, each of said auxiliary adjustable support members comprising a base member for securement to the rectangular framework, and an auxiliary adjustable support table being slidably-adjustably-disposed along a longitudinal axis of said base member, said auxiliary adjustable support table being secured in spaced-apart orientation along the interior periphery of said universal press frame, along the side rails, along the front rail and along the rear rail by cooperation with said dovetail groove in said rails, and said auxiliary adjustable support tables being adjusted with respect to said base member to have the leading edge oriented substantially-parallel to a part of the universal press frame to which the auxiliary adjustable support members is secured, in such a way that an "imaginary" perimeter which would be defined by joining the front edges of said auxiliary adjustable support tables constitutes a perimeter that is substantially-similar to, but is slightly larger than, the perimetrical shape of a sheet containing carton blanks which have been die-cut from a sheet by the male cutting die of the die cutting machine, so that said auxiliary adjustable support tables provide a temporary support for selected areas of the sheet containing carton blanks which have been die-cut from a sheet by a male cutting die of said die cutting machine.

7. The universal press frame as claimed in claim 1, including legs secured to selected said rails, to support said universal press frame above a base support.

* * * * *